US007702504B2

(12) United States Patent
Son et al.

(10) Patent No.: US 7,702,504 B2
(45) Date of Patent: Apr. 20, 2010

(54) BITRATE SCALABLE SPEECH CODING AND DECODING APPARATUS AND METHOD

(75) Inventors: Chang-yong Son, Seoul (KR); Kang-eun Lee, Gangwon-do (KR); Sang-won Kang, Gyeonggi-do (KR); Sang-hyun Chi, Gangwon-do (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 1217 days.

(21) Appl. No.: 10/886,662

(22) Filed: Jul. 9, 2004

(65) Prior Publication Data

US 2005/0010404 A1 Jan. 13, 2005

(30) Foreign Application Priority Data

Jul. 9, 2003 (KR) ..... 10-2003-0046324
Jun. 3, 2004 (KR) ..... 10-2004-0040478

(51) Int. Cl.
*G10L 19/00* (2006.01)

(52) U.S. Cl. ..... 704/219; 704/500; 704/501

(58) Field of Classification Search ..... 704/219, 704/500, 501

See application file for complete search history.

(56) References Cited

U.S. PATENT DOCUMENTS 5,265,190 A * 11/1993 Yip et al. ..... 704/219
6,226,616 B1 * 5/2001 You et al. ..... 704/500
6,292,777 B1 * 9/2001 Inoue et al. ..... 704/230
7,072,366 B2 * 7/2006 Parkkinen et al. ..... 370/538
7,249,014 B2 * 7/2007 Kannan et al. ..... 704/219
2002/0095283 A1 * 7/2002 Manjunath ..... 704/205
2002/0107686 A1 * 8/2002 Unno ..... 704/219
2003/0004710 A1 * 1/2003 Gao ..... 704/219
2003/0088328 A1 * 5/2003 Nishio et al. ..... 700/94
2003/0206558 A1 * 11/2003 Parkkinen et al. ..... 370/477
2004/0049381 A1 * 3/2004 Kawahara ..... 704/219

(Continued)

FOREIGN PATENT DOCUMENTS

EP 0 772 186 A2 5/1997

OTHER PUBLICATIONS

Nomura, T.; lwadare, M. Serizawa, M.; Ozawa, K., "A bitrate and bandwidth scalable CELP coder," Procs. IEEE ICASSP 1998, pp. 341-344 vol.1, May 12-15, 1998.*

(Continued)

*Primary Examiner*—Richemond Dorvil
*Assistant Examiner*—Douglas C Godbold

(57) ABSTRACT

A coding apparatus including a base layer, a speech quality enhancement layer, and a multiplexer. The base layer filters an input speech signal using linear prediction coding and generates an excitation signal corresponding to the filtered speech signal through a fixed codebook search and an adaptive codebook search. The speech quality enhancement layer searches a fixed codebook using parameters obtained through the fixed codebook search in the base layer, or searches the fixed codebook using a target signal, which is obtained by removing a contribution of a fixed codebook of the base layer and a signal which is obtained by synthesizing and filtering a previous fixed codebook of the speech quality enhancement layer from a target signal for the fixed codebook search of the base layer. The multiplexer multiplexes signals generated by the base layer and the at least one speech quality enhancement layer.

28 Claims, 11 Drawing Sheets

U.S. PATENT DOCUMENTS

2006/0173677 A1* 8/2006 Sato et al. ..... 704/223

OTHER PUBLICATIONS

Murashima, A.; Serizawa, M.; Ozawa, K., "A post-processing technique to improve coding quality of CELP under background noise," Procs. 2000 IEEE Workshop on Speech Coding, pp. 102-104, 2000.*

Murashima, A.; Serizawa, M.; Ozawa, K., "Multi-rate wideband speech codec robust to background noise", Procs. IEEE ICASSP 2000, pp. 1165-1168, 2000.*

Koishida, K.; Cuperman, V.; Gersho, A., "A 16-kbit/s bandwidth scalable audio coder based on the G.729 standard," Procs. IEEE ICASSP 2000, pp. 1149-1152, 2000.*

Pohlmann, Ken C., "Principles of Digital Audio,"4th Ed. MicGraw Hill, 2000 pp. 596-599.*

Civanlar, M. Reha, "Internet Video- Protocols & Applications," Proc of the 11th International Packet Video Workshop, May 2001.*

Bustos, J.; Bassi, A., "Voice compression systems for wireless telephony," Proceedings. XXI Internatinal Conference of the Chilean Computer Science Society, 2001. pp. 41-49.*

Korean Intellectual Property Office Notice to Submit Response issued by the Korean Patent Office on Feb. 28, 2006 in Application No. 10-2004-0040478.

Koishida K et al: "A 16-Kbit/s Bandwidth Scalable Audio Coder Based on the G.729 Standard," *2000 IEEE International Conference on Acoustics, Speech and Signal Processing. Proceedings* (*ICASSP*), Istanbul, Turkey, IEEE, US, vol. 2 of 6, Jun. 5, 2000, pp. 1149-1152.

Nomura T et al: "A bitrate and bandwidth scalable CELP coder," *Proceedings of the 1998 IEEE International Conference*, Seattle, WA, USA, IEEE, US, May 12, 1998, pp. 341-344.

Nomura T et al: "Voice over IP systems with speech bitrate adaptation based on MPEG-4 wideband CELP," *Speech Coding Proceedings*, Finland, IEEE, US, Jun. 20, 1999, pp. 132-134.

* cited by examiner

BITRATE SCALABLE SPEECH CODING AND DECODING APPARATUS AND METHOD

CROSS-REFERENCE TO RELATED APPLICATIONS

This application claims the priority of Korean Patent Application Nos. 2003-46324 and 2004-40478, filed on Jul. 9, 2003 and Jun. 3, 2004, respectively, in the Korean Intellectual Property Office, the disclosures of which are hereby incorporated by reference in its entirety.

BACKGROUND OF THE INVENTION

1. Field of the Invention

The invention relates to a speech codec employing a code excited linear prediction (CELP) algorithm, and more particularly, to a signal-to-noise ratio (SNR) bit rate scalable speech coding and decoding apparatus and method of speech quality enhancement.

2. Description of the Related Art

Speech codecs employing a code excited linear prediction (CELP) algorithm are currently most popular for use in mobile communication systems. CELP speech codecs are based on linear prediction coding (LPC). Transmission rates and bandwidths of the speech codecs vary according to the type of service to which they are applied.

However, the transmission rates and bandwidths of general speech codecs are set by coding apparatuses, not by decoding apparatuses. Further, when a multicasting, in which a packet is sent from one transmitter to a plurality of receivers over a network, is performed, if the speech codec used on a side of the transmitter has a fixed bit rate, the quality of the packet transmitted to the plurality of receivers, which request a variety of bit rates, may deteriorate.

To solve this problem, speech codecs adopting a bit rate scalable speech coding method has been developed. Such speech codecs configure a bit stream containing base codec information and additional information such that quality of a signal transmitted can be more accurately restored.

Conventional bit rate scalable coding methods are classified into a signal-to-noise (SNR) bit rate scalable method and a bandwidth scalable method.

The SNR bit rate scalable speech coding method codes and decodes a speech signal using hierarchical coding. That is, the SNR bit rate scalable speech coding method codes a speech signal in a base layer and a speech quality enhancement layer, respectively. The base layer transmits only information for restoring the least of the speech quality, and the speech quality enhancement layer transmits additional information for enhancing the speech quality.

However, conventional SNR bit rate scalable coding apparatuses are constructed such that the speech quality enhancement layer is independent of the base layer. Thus, since calculations of energy and a correlation between an impulse response and a target signal (or target vector) necessary for a fixed codebook search are performed respectively in the base layer and the speech quality enhancement layer, a great number of calculations are required to obtain parameters for the fixed codebook search.

Furthermore, since the conventional SNR bit rate scalable coding apparatuses change the structures of existing standard CELP speech codecs to additionally operate the speech quality enhancement layer, the conventional apparatuses are not compatible with the existing standard CELP speech codecs.

SUMMARY OF THE INVENTION

The invention provides a signal-to-noise (SNR) bit rate scalable speech coding and decoding apparatus, which includes a fixed codebook of an existing standard speech codec and a multi-layered fixed codebook, and thus, is compatible with the existing standard speech codec, and a method of using the SNR bit rate scalable speech coding and decoding apparatus.

The invention also provides an SNR bit rate scalable speech coding and decoding apparatus, which reduces the number of calculations for obtaining parameters for fixed codebook search, and a method of using the SNR bit rate scalable speech coding and decoding apparatus.

The invention further provides an SNR bit rate scalable speech coding and decoding apparatus, which searches a fixed codebook of a speech quality enhancement layer using a contribution of a fixed codebook searched in a base layer and a target signal from which a synthesized excitation signal of the speech quality enhancement layer is removed, and a method of using the SNR bit rate scalable speech coding and decoding apparatus.

The invention further provides an SNR bit rate scalable speech coding and decoding apparatus, which permits a pulse position searched in a base layer and a pulse position searched in a speech quality enhancement layer to be the same, thereby overcoming the limitations of an algebraic codebook, and a method of using the SNR bit rate scalable speech coding and decoding apparatus.

The invention also provides an SNR bit rate scalable speech coding and decoding apparatus, which can reduce the number of quantized bits corresponding to a gain value of a fixed codebook in a speech quality enhancement layer.

According to an aspect of the invention, there is provided a speech signal coding apparatus including a base layer filtering an input speech signal using linear prediction coding and generating an excitation signal corresponding to the filtered speech signal through fixed codebook search and adaptive codebook search; one or more speech quality enhancement layer searching a fixed codebook using parameters obtained through the fixed codebook search performed by the base layer; and a multiplexer multiplexing signals generated by the base layer and the speech quality enhancement layer and outputting the multiplexed signal.

According to another aspect of the invention, there is provided a speech signal coding apparatus including a base layer filtering an input speech signal using linear prediction coding and generating an excitation signal corresponding to the filtered speech signal through fixed codebook search and adaptive codebook search; a plurality of speech quality enhancement layers, each of which includes a fixed codebook searching unit searching a fixed codebook using parameters obtained through the fixed codebook search in the base layer, and a gain value quantizing unit detecting a difference between a first fixed codebook gain values generated through the fixed codebook search in the base layer and a second fixed codebook gain value output from the fixed codebook searching unit and quantizing the detected difference; and a multiplexer multiplexing signals generated by the base layer and the speech quality enhancement layer.

According to another aspect of the invention, there is provided a speech signal coding apparatus including a base layer filtering an input speech signal using linear prediction coding and generating an excitation signal corresponding to the filtered speech signal through fixed codebook search and adaptive codebook search; a plurality of speech quality enhancement layers, each of which includes a fixed codebook searching unit searching a fixed codebook using parameters obtained through the fixed codebook search in the base layer, and a gain value quantizing unit detecting a difference between a first fixed codebook gain values generated through the fixed codebook search in the base layer and a second fixed codebook gain value output from the fixed codebook searching unit and quantizing the detected difference; and a multiplexer multiplexing signals generated by the base layer and the speech quality enhancement layer.

According to another aspect of the invention, there is provided a speech signal decoding apparatus decoding a speech signal separately coded by a base layer and at least one speech quality enhancement layer, the speech signal decoding apparatus includes a first decoding unit decoding coding information in the base layer from the coded speech signal; a second decoding unit decoding coding information in the speech quality enhancement layer from the coded speech signal according to an operating environment of the speech signal decoding apparatus; a calculating unit calculating a signal output from the first decoding unit and a signal output from the second decoding unit, according to the operating environment of the speech signal decoding apparatus; and a speech signal restoring unit synthesizing a signal output from the calculating unit using a linear prediction coding coefficient output from the first decoding unit and restoring the speech signal.

The first decoding unit may include a linear prediction coding coefficient decoding unit decoding linear prediction coding coefficient quantization information included in the coding information in the base layer; a first fixed codebook decoding unit decoding a fixed codebook index included in the coding information in the base layer; an adaptive codebook decoding unit decoding an adaptive codebook index included in the coding information in the base layer; and a gain value decoding unit decoding a fixed codebook gain value and an adaptive codebook gain value included in the coding information in the base layer.

The second decoding unit may include a gain difference decoding unit decoding quantization information regarding a difference between fixed codebook gain values included in the coding information in the speech quality enhancement layer; and a second fixed codebook decoding unit decoding a fixed codebook index included in the coding information in the speech quality enhancement layer.

The second decoding unit may include a gain difference decoding unit decoding quantization information regarding a difference between log scale gain values of the fixed codebook included in the coding information of the speech quality enhancement layer; and a second fixed codebook decoding unit decoding a fixed codebook index included in the coding information of the speech quality enhancement layer.

The second decoding unit may include a gain difference decoding unit decoding a difference between fixed codebook log scale gain values included in the coding information in the speech quality enhancement layer; and a fixed codebook decoding unit decoding a fixed codebook index included in the coding information of the speech quality enhancement layer.

According to another aspect of the invention, there is provided a speech signal coding method including the operations of: extracting a linear prediction coding coefficient from an input speech signal and generating an excitation signal corresponding to the input speech signal through fixed codebook search and adaptive codebook search, in a base layer; searching a fixed codebook using parameters obtained through the fixed codebook search in the base layer; and multiplexing signals generated in the base layer and the speech quality enhancement layer, in at least one speech quality enhancement layer.

The operation of the speech quality enhancement layer may be performed in multiple layers.

According to another aspect of the invention, there is provided a method of decoding a speech signal separately coded by a base layer and by at least one speech quality enhancement layer, the method including the operations of: decoding the coded speech signal; selectively transmitting one of a codebook of the base layer and a codebook of the speech quality enhancement layer, which are decoded in the decoding operation of the coded speech signal, according to operating conditions; and generating a restored speech signal by synthesizing the selectively transmitted codebook with a linear prediction coding coefficient, which is decoded in the decoding operation of the coded speech signal.

According to another aspect of the invention, there is provided a speech signal coding apparatus including a base layer filtering an input speech signal using linear prediction coding, and generating an excitation signal of the filtered speech signal through fixed codebook search and adaptive codebook search; one or more speech quality enhancement layer searching a fixed codebook using a target signal, which is obtained by removing a contribution of a fixed codebook of the base layer from a target signal for the fixed codebook search of the base layer; and a multiplexer multiplexing signals generated in the base layer and the speech quality enhancement layer, and outputting the multiplexed signal.

The fixed codebook contribution $y_2(n)$ of the base layer may be calculated by the following equation using a fixed codebook $c_G$ by which a quantized gain value of the fixed codebook of the base layer is multiplied and an impulse response h(n) of a synthesis filter $$y_2(n) = \sum_{l=0}^{N-1} c_G(l)h(n-l).$$

The speech quality enhancement layer may further remove a signal, which is obtained by synthesizing a fixed codebook signal generated in the speech quality enhancement layer using the linear prediction coding coefficient, from the target signal of the base layer.

The speech quality enhancement layer may further include multiplying a fixed codebook vector obtained through the fixed codebook search of the speech quality enhancement layer by a quantized gain value of the speech quality enhancement layer, which is obtained by quantizing a difference between a log scale value of a first gain value obtained through the fixed codebook search of the base layer and a log scale value of a second gain value obtained through the fixed codebook search of the speech quality enhancement layer.

The speech quality enhancement layer may filter the target signal with a perceptual weighting filter, and then perform the fixed codebook search.

According to another aspect of the invention, there is provided a speech signal coding apparatus including a base layer filtering an input speech signal using linear prediction coding, and generating an excitation signal corresponding to the filtered speech signal through fixed codebook search and adaptive codebook search; a plurality of speech quality enhancement layers, each of which includes: a fixed codebook searching unit searching a fixed codebook using a target signal, which is obtained by removing a fixed codebook contribution of fixed codebook of the base layer from a target signal for the fixed codebook search of the base layer; and a log scale gain difference quantizer detecting and quantizing a difference between a log scale gain value of a fixed codebook generated through the fixed codebook search of the base layer and a log scale gain value of a second fixed codebook output from the fixed codebook searching unit; and a demultiplexer demultiplexing signals generated in the base layer and the speech quality enhancement layer, wherein the speech quality enhancement layer further removes a signal, which is obtained by synthesizing a fixed codebook using a linear prediction coding coefficient in the speech quality enhancement layer, from the target signal for the fixed codebook search of the speech quality enhancement layer.

According to another aspect of the invention, there is provided a method of coding a speech signal including the operations of: extracting a linear prediction coding coefficient of an input speech signal and generating an excitation signal corresponding to the input speech signal through fixed codebook search and adaptive codebook search, in a base layer; searching a fixed codebook using a target signal, which is obtained by removing a fixed codebook contribution of the base layer from a target signal for the fixed codebook search of the base layer; and multiplexing signals generated in the base layer and the speech quality enhancement layer, in a speech quality enhancement layer.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
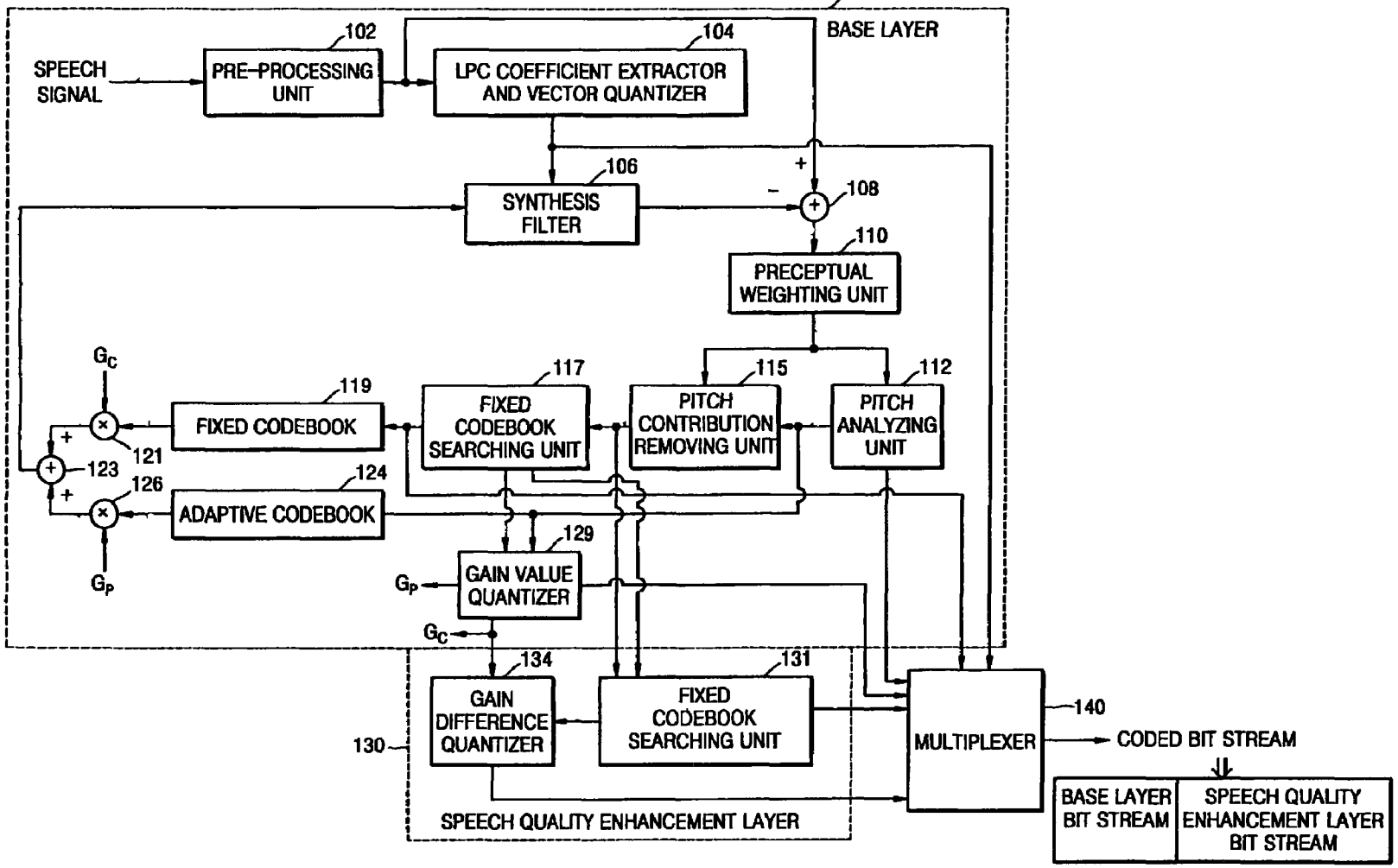
FIG. 1 is a block diagram of a bit rate scalable speech coding apparatus according to an aspect of the invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a block diagram of a bit rate scalable speech coding apparatus according to an aspect of the invention. Referring to FIG. 1, the bit rate scalable speech coding apparatus has a multi-layered fixed codebook structure, including a base layer 100 and a speech quality enhancement layer 130. The base layer 100 generates coding information for restoring a least speech quality. The base layer 100 is similar in configuration to an existing standard code excited linear prediction (CELP) speech codec. Therefore, the base layer 100 filters an input speech signal using linear prediction coding (LPC) and generates an excitation signal corresponding to the input speech signal.

The base layer 100 includes a pre-processing unit 102, an (LPC) coefficient extractor and vector quantizer 104, a synthesis filter 106, a subtractor 108, a perceptual weighting filter 110, a pitch analyzing unit 112, a pitch contribution removing unit 115, a fixed codebook searching unit 117, a fixed codebook 119, a first multiplier 121, an adder 123, an adaptive codebook 124, a second multiplier 126, and a gain value quantizer 129.

The pre-processing unit 102 removes a direct current (DC) component from a speech signal. That is, the pre-processing unit 102 filters the input speech signal using a high pass filter to remove a noise component of a low frequency band of the input speech signal. The used high pass filter $H_{h1}(n)$ has a transfer function as shown in Equation (1)

$$H_{hl}(n) = \frac{0.46363718 - 0.92724705z^{-1} + 0.46363718z^{-2}}{1 - 1.9059465z^{-1} + 0.9114024z^{-2}}. \quad (1)$$

A signal output from the pre-processing unit 102 is transmitted to the LPC coefficient extractor and vector quantizer 104.

The LPC coefficient extractor and vector quantizer 104 extracts an LPC coefficient of the signal output from the pre-processed unit 102. The extracted LPC coefficient is vector quantized by the LPC coefficient extractor and vector quantizer 104. Vector quantization information of the LPC coefficient is transmitted to the synthesis filter 106 and a multiplexer 140.

The synthesis filter 106 outputs a synthesized signal corresponding to an excitation signal using the vector quantization information of the LPC coefficient. The synthesized signal is output to the subtractor 108.

The subtractor 108 subtracts the synthesized signal from the signal output from the pre-processing unit 102, thereby producing a difference signal. The difference signal is transmitted to the perceptual weighting filter 110.

The perceptual weighting filter 110 maintains a quantizing noise below a masking threshold to use a masking effect of the human hearing organ. Thus, the perceptual weighting filter 110 outputs a signal including a weight for minimizing a quantizing noise of the difference signal to the pitch analyzing unit 112.

The pitch analyzing unit 112 searches an open-loop pitch and a closed-loop pitch of the signal output from the perceptual weighting filter 110. That is, the pitch analyzing unit 112 divides the signal output from the perceptual weighting filter 110 into a plural of subframes, analyzes a pitch of each subframe, and outputs an index and a gain value of the adaptive codebook. The index of the adaptive codebook is transmitted to the pitch contribution removing unit 115 and the adaptive codebook 124 and to the multiplexer 140. The gain value of the adaptive codebook is provided to the gain value quantizer 129.

The pitch contribution removing unit 115 detects a target signal (or a target vector) necessary for fixed codebook search from the signal output from the perceptual weighting filter 110 using the index of the adaptive codebook 124. The pitch contribution removing unit 115 subtracts a pitch contribution $y_1(n)$ and outputs the target signal necessary for the fixed codebook search to the fixed codebook searching unit 117 of the base layer 100 and a fixed codebook searching unit 131 of the speech quality enhancement layer 130. The pitch contribution $y_1(n)$ is obtained by Equation (2)

$$y_1(n) = \sum_{l=0}^{N-1} AC_G(l)h(n-l) \tag{2}$$

where $AC_G(n)$ represents a value by which the gain value of the adaptive codebook 124 is multiplied.

The fixed codebook searching unit 117 obtains a correlation d(n) between the target signal and an impulse response h(n) using the target signal x'(n).

For example, when the size of a subframe is 40 samples and the number of pulses of each layer is 4, the correlation d(n) is defined as $$d(n) = \sum_{i=n}^{39} x'(n)h(i-n) \quad n = 0, \ldots, 39, \tag{3}$$

where h(i-n) represents the impulse response and x'(n) represents the target signal.

The impulse response h(n) and the correlation d(n) are provided to the fixed codebook searching unit 131 of the speech quality enhancement layer 130.

The fixed codebook searching unit 117 searches a fixed codebook with a structure as shown in Table 1 using the impulse response h(n) and the correlation d(n).

TABLE 1

| Pulse | Sign | Pulse Position |
|---|---|---|
| $i_0$ | $s_0$: ±1 | $m_0$: 0, 5, 10, 15, 20, 25, 30, 35 |
| $i_1$ | $s_1$: ±1 | $m_1$: 1, 6, 11, 16, 21, 26, 31, 36 |
| $i_2$ | $s_2$: ±1 | $m_2$: 2, 7, 12, 17, 22, 27, 32, 37 |
| $i_3$ | $s_3$: ±1 | $m_3$: 3, 8, 13, 18, 23, 28, 33, 38<br>4, 9, 14, 19, 24, 29, 34, 39 |

Referring to Table 1, a magnitude of a pulse of a fixed codebook vector in the fixed codebook searching unit 117 is non-zero in only four positions. Accordingly, a correlation C can be defined by Equation (4) using a sign s of each pulse and the correlation d(n). The fixed codebook searching unit 117 detects the correlation C using Equation (4)

$$C = \sum_{i=0}^{3} s_i d(m_i) = |d(m_0)| + |d(m_1)| + |d(m_2)| + |d(m_3)|, \tag{4}$$

where $m_i$ represents an $i^{th}$ pulse position, and $s_i$ represents a sign of an $i^{th}$ pulse.

The fixed codebook searching unit 117 detects energy E of the impulse response h(n) of the synthesis filter 106 using Equation (5)

$$E = \sum_{i=0}^{3} \phi(m_i, m_i) + 2\sum_{i=0}^{2}\sum_{j=i+1}^{3} s_i s_j \phi(m_i, m_j), \tag{5}$$

where $\Phi(m_i, m_j)$ represents a correlation between the impulse responses h(n) with respect to $i^{th}$ and $j^{th}$ pulse positions, $s_i$ is a sign of an $i^{th}$ pulse, and $s_j$ is a sign of a $j^{th}$ pulse.

The fixed codebook searching unit 117 stores the correlation C and the energy E of the impulse response h(n). The fixed codebook searching unit 117 divides the correlation C into a sign [d(i)] and its absolute value and stores them. The sign[d(i)] is a sign of d(i). The energy E is stored as $$\phi'(i,j) = \text{sign}[d(i)]\text{sign}[d(j)]\phi(i,j) \quad i=0, \ldots, 39 \; j=i+1, \ldots, 39$$

$$\text{If } i=j, \text{ then } \phi'(i,j) = 0.5\phi'(i,j) \quad i=0, \ldots, 39 \tag{6}$$

Equation 5 for the energy E can be rewritten as $$\begin{aligned} E/2 = {} & \phi'(m_0, m_0) + \phi'(m_1, m_1) + \phi'(m_0, m_1) + \\ & \phi'(m_2, m_2) + \phi'(m_0, m_2) + \phi'(m_1, m_2) + \\ & \phi'(m_3, m_3) + \phi'(m_0, m_3) + \phi'(m_1, m_3) + \\ & \phi'(m_2, m_3). \end{aligned} \tag{7}$$

The fixed codebook searching unit 117 outputs the detected correlation C and energy E to the fixed codebook searching unit 131 of the speech quality enhancement layer 130 and searches the fixed codebook using the detected correlation C and energy E. If an index and a gain value of the fixed codebook is obtained through the fixed codebook search, the fixed codebook searching unit 117 transmits the index of the fixed codebook to the fixed codebook 119 and the multiplexer 140 and transmits the gain value to the gain value quantizer 129.

The fixed codebook 119 outputs a fixed codebook vector of the base layer 100 using the index transmitted. The fixed codebook vector output from the fixed codebook 119 is provided to the first multiplier 121.

The first multiplier 121 multiplies a quantized gain value $G_C$ corresponding to the gain value of the fixed codebook provided from the gain value quantizer 139 by the fixed codebook vector and outputs the result. The quantized gain value $G_C$ is provided from the gain value quantizer 129.

If the index of the adaptive codebook is input from the pitch analyzing unit 112, the adaptive codebook 124 outputs pulse position information and sign information corresponding to the index of the adaptive codebook. The adaptive codebook vector output is transmitted to the second multiplexer 126.

The second multiplier 126 multiplies a quantized gain value $G_P$ corresponding to the gain value of the adaptive codebook by the adaptive codebook vector and outputs the result. The signal output is a signal obtained by multiplying the adaptive codebook vector by the quantized gain value $G_P$. The quantized gain value $G_P$ is provided from the gain value quantizer 129.

The adder 123 adds the signal obtained by multiplying the fixed codebook vector by the gain value $G_C$ to the signal obtained by multiplying the adaptive codebook vector by the quantized gain value $G_P$, to obtain the excitation signal. The excitation signal is output to the synthesis filter 106.

The gain value quantizer 129 quantizes the gain value of the fixed codebook output from the fixed codebook searching unit 117 and the gain value of the adaptive codebook output from the pitch analyzing unit 112. The quantized gain value $G_C$ of the fixed codebook is output to the first multiplier 121 and the quantized gain value $G_P$ of the adaptive codebook is output to the second multiplier 126. The quantized gain value $G_C$ is also output to a gain difference quantizer 134 in the speech quality enhancement layer 130.

The speech quality enhancement layer 130 provides additional bits to bits provided from the base layer 100 to enhance the quality of restored speech. For example, when the base layer 100 provides a bit rate of 8 KB/sec, the speech quality enhancement layer 130 can provide an additional bit rate of 4 KB/sec. Although, referring to FIG. 1, only one speech quality enhancement layer 130 is connected to the base layer 100 for the convenience of description, a plurality of speech quality enhancement layers may be connected to the base layer 100.

The speech quality enhancement layer 130 includes the fixed codebook searching unit 131 and the gain difference quantizer 134.

The fixed codebook searching unit 131 searches a fixed codebook using the impulse response h(n), the correlation d(n) between the target signal and the impulse response h(n), the correlation C corresponding to the magnitude information of the d(n), which is detected using the sign of each pulse and the correlation d(n), and the energy E of the impulse response h(n).

Thus, the fixed codebook searching unit 131 performs the fixed codebook search for the same target signal as the target signal searched by the fixed codebook searching unit 117. The fixed codebook searching unit 131 uses an algebraic codebook. The fixed codebook searching unit 131 searches a vector $c_k$, which minimizes a mean square error (MSE) of the target signal (or target vector) and maximizes a value expressed below as Equation 8. The searched vector $c_k$ becomes the fixed codebook vector.

$$\frac{C_k^2}{E_k} = \frac{\left(\sum_{n=0}^{N} d(n)c_k(n)\right)^2}{c_k^t \Phi c_k} \tag{8}$$

The value of Φ represents a correlation between the impulse responses h(n). The values of d(n) and Φ are provided from the base layer 100. Specifically, the value of Φ is provided from the fixed codebook searching unit 117. Accordingly, the fixed codebook searching unit 131 of the speech quality enhancement layer reduces the number of calculations required for the fixed codebook search.

When it is assumed that a degree of the fixed codebook vector of the base layer 100 is 40 and the base layer 100 and the speech quality enhancement layer 130 search respectively four non-zero pulses, the fixed codebook searching unit 117 of the base layer 100 searches four pulses and then the fixed codebook searching unit 131 of the speech quality enhancement layer 130 searches four pulses. Accordingly, the fixed codebook searching unit 131 considers the influences of the four pulses searched by the base layer 100. Hence, a correlation C' obtained by the fixed codebook searching unit 131 is defined in Equation 9 as:

$$\begin{aligned} C' &= \sum_{i=0}^{7} s_i d(m_i) \\ &= |d(m_0)| + |d(m_1)| + |d(m_2)| + |d(m_3)| + |d(m_4)| + |d(m_5)| + \\ &\quad |d(m_6)| + |d(m_7)| \end{aligned} \tag{9}$$

and energy E' is defined in Equation 10 as:

$$E' = \sum_{i=0}^{7} \phi(m_i, m_i) + 2\sum_{i=0}^{6}\sum_{j=i+1}^{7} s_i s_j \phi(m_i, m_j). \tag{10}$$

Using the correlation C, as defined in Equation 4, Equation 9 can be rewritten as:

$$C' = C + |d(m_4)| + |d(m_5)| + |d(m_6)| + |d(m_7)| \tag{11}$$

To reduce the complexity of the search by the fixed codebook searching unit 131, the fixed codebook searching unit 131 may detect the energy E' through a calculation redefined as:

$$\begin{aligned} E'/2 = {} & \phi'(m_0, m_0) + \phi'(m_1, m_1) + \phi'(m_0, m_1) + \phi'(m_2, m_2) + \\ & \phi'(m_0, m_2) + \phi'(m_1, m_2) + \phi'(m_3, m_3) + \phi'(m_0, m_3) + \\ & \phi'(m_1, m_3) + \phi'(m_2, m_3) + \phi'(m_4, m_4) + \phi'(m_0, m_4) + \\ & \phi'(m_1, m_4) + \phi'(m_2, m_4) + \phi'(m_3, m_4) + \phi'(m_5, m_5) + \\ & \phi'(m_0, m_5) + \phi'(m_1, m_5) + \phi'(m_2, m_5) + \phi'(m_3, m_5) + \\ & \phi'(m_4, m_5) + \phi'(m_6, m_6) + \phi'(m_0, m_6) + \phi'(m_1, m_6) + \\ & \phi'(m_2, m_6) + \phi'(m_3, m_6) + \phi'(m_4, m_6) + \phi'(m_5, m_6) + \\ & \phi'(m_7, m_7) + \phi'(m_0, m_7) + \phi'(m_1, m_7) + \phi'(m_2, m_7) + \\ & \phi'(m_3, m_7) + \phi'(m_4, m_7) + \phi'(m_5, m_7) + \phi'(m_6, m_7). \end{aligned} \tag{12}$$

Equation 12 can be redefined as Equation (13) using the energy E as defined in Equation 7, as follows:

$$\begin{aligned} E'/2 = {} & E/2 + \phi'(m_4, m_4) + \phi'(m_0, m_4) + \\ & \phi'(m_1, m_4) + \phi'(m_2, m_4) + \phi'(m_3, m_4) + \phi'(m_5, m_5) + \\ & \phi'(m_0, m_5) + \phi'(m_1, m_5) + \phi'(m_2, m_5) + \phi'(m_3, m_5) + \\ & \phi'(m_4, m_5) + \phi'(m_6, m_6) + \phi'(m_0, m_6) + \phi'(m_1, m_6) + \\ & \phi'(m_2, m_6) + \phi'(m_3, m_6) + \phi'(m_4, m_6) + \phi'(m_5, m_6) + \\ & \phi'(m_7, m_7) + \phi'(m_0, m_7) + \phi'(m_1, m_7) + \phi'(m_2, m_7) + \\ & \phi'(m_3, m_7) + \phi'(m_4, m_7) + \phi'(m_5, m_7) + \phi'(m_6, m_7). \end{aligned} \tag{13}$$

The correlation C' and the energy E' are stored prior to the fixed codebook search by the speech quality enhancement layer 130 to simplify the fixed codebook search.

A process performed by the fixed codebook search unit 131 to obtain pulse sign information and position information of the speech quality enhancement layer 130 using the correlation C' and the energy E' is carried out in the same way as performed by the fixed codebook searching unit 117 of the base layer 100. Here, the pulse position information searched by the base layer 100 and the pulse position information searched by the speech quality enhancement layer 130 may be the same.

Figure 2:
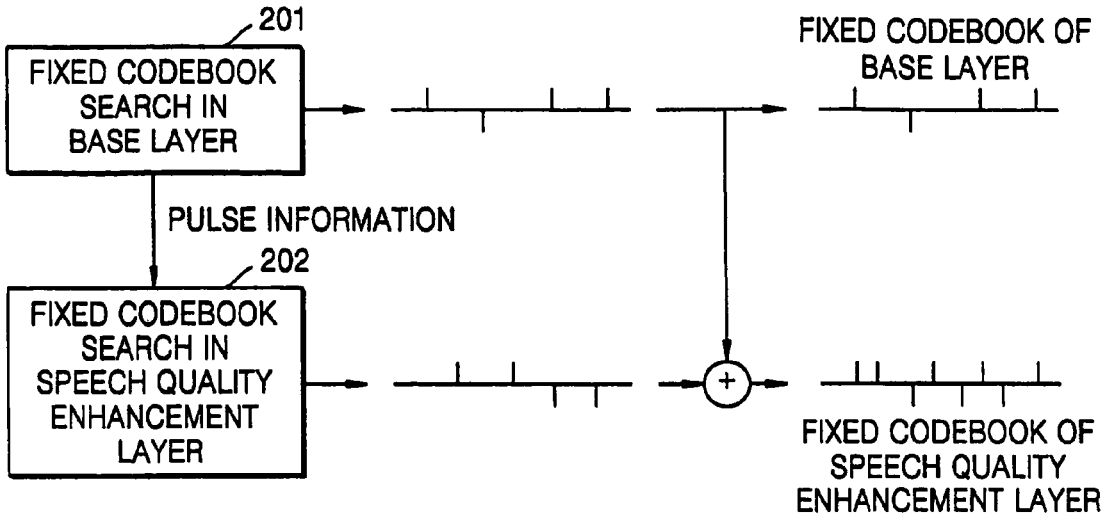
FIG. 2 is a diagram illustrating a pulse position searched by a fixed codebook searching unit of a base layer and a pulse position searched by a fixed codebook searching unit of a speech quality enhancement layer in the bit rate scalable speech coding apparatus of FIG. 1.

FIG. 2 is a diagram illustrating a pulse position searched by the fixed codebook searching unit 117 and a pulse position searched by the fixed codebook searching unit 131 in the bit rate scalable speech coding apparatus of FIG. 1.

Referring to FIG. 2, a pulse position searched through a fixed codebook search 201 of the base layer may be the same as a pulse position searched through a fixed codebook search 202 of the speech quality enhancement layer. Accordingly, a final fixed codebook pulse has a multiple magnitude, including sizes of fixed codebook pulses of the base layer 100 and the speech quality enhancement layer 130. Thus, a pulse in the algebraic codebook does not have only +1 or −1.

The fixed codebook searching unit 131 outputs the fixed codebook vector obtained through the search to the multiplexer 140, and outputs a gain value of the fixed codebook to the gain difference quantizer 134. The fixed codebook index in the speech quality enhancement layer 130 can include the pulse sign information and pulse position information.

The fixed codebook index searched by the speech quality enhancement layer 130 is not stored for a next frame, therefore, it does not affect the operation of the base layer 100.

The gain difference quantizer 134 determines a difference between the gain value 132 of the fixed codebook obtained by the fixed codebook searching unit 131 and the quantized gain value $G_C$ of the fixed codebook obtained by the base layer 100, and quantizes the difference. Accordingly, since gain difference quantization information $G_{diff}$ is transmitted from the gain difference quantizer 134 to the multiplexer 140, the speech quality enhancement layer 130 can reduce quantization bits allocated to the gain value of the fixed codebook.

The multiplexer 140 multiplexes the LPC coefficient quantization information, the fixed codebook index, the adaptive codebook index, and the gain value quantization information, which are provided from the base layer, and the fixed codebook index and the gain difference quantization information, which are provided from the speech quality enhancement layer, to obtain bit streams.

The bit streams of the base layer 100 and the speech quality enhancement layer 130 are separately transmitted. That is, the bit stream of the speech quality enhancement layer 130 is transmitted following the bit stream of the base layer 100, as shown in FIG. 1. Accordingly, the bit streams can be easily separated at a bit rate necessary for a decoding apparatus according to network traffic conditions. For example, when channel characteristics of the decoding apparatus are so poor that the decoding apparatus can receive only the bit stream of the base layer, the decoding apparatus can receive only the bit stream of the base layer from the bit streams transmitted by the bit rate scalable speech coding apparatus as shown in FIG. 1.

Figure 3:
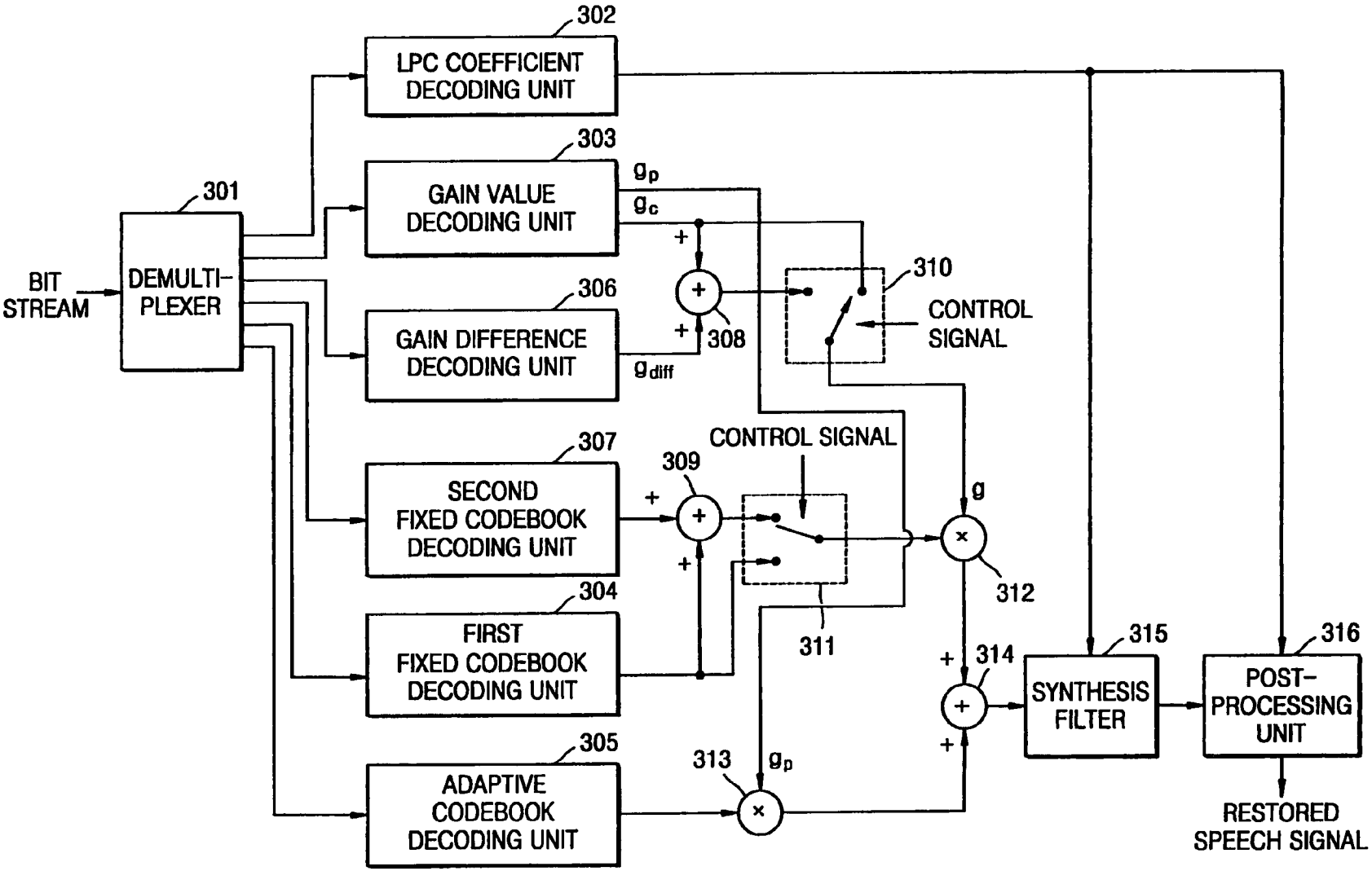
FIG. 3 is a block diagram of a bit rate scalable speech decoding apparatus according to an aspect of the invention.

FIG. 3 is a block diagram of a bit rate scalable speech decoding apparatus according to an aspect of the invention. Referring to FIG. 3, the decoding apparatus includes a demultiplexer 301, an LPC coefficient decoding unit 302, a gain value decoding unit 303, a first fixed codebook decoding unit 304, an adaptive codebook decoding unit 305, a gain difference decoding unit 306, a second fixed codebook decoding unit 307, a first adder 308, a second adder 309, a first selector switch 310, a second selector switch 311, a first multiplier 312, a second multiplier 313, a third adder 314, a synthesis filter 315, and a post-processing unit 316.

The bit rate scalable speech decoding apparatus can receive selectively a bit stream transmitted from the bit rate scalable speech coding apparatus. That is, if the bit rate scalable speech decoding apparatus receives only the bit stream of the base layer, it can only restore speech quality of the base layer However, if the bit rate scalable speech decoding apparatus receives both the bit streams of the base layer and the speech quality enhancement layer, it can provide improved speech quality.

The demultiplexer 301 demultiplexes the received bit stream into information of each module and outputs the demultiplexed bit stream. That is, the demultiplexer 301 outputs LPC coefficient quantization information to the LPC coefficient decoding unit 302, gain value quantization information to the gain value decoding unit 303, gain difference quantization information to the gain difference decoding unit 306, a fixed codebook index of the speech quality enhancement layer to the second fixed codebook decoding unit 307, a fixed codebook index to the first fixed codebook decoding unit 304, and an adaptive codebook index of the base layer to the adaptive codebook decoding unit 305.

The structure of the LPC coefficient decoding unit 302 is determined by the LPC coefficient extractor and vector quantizer 104 of the coding apparatus. The LPC coefficient decoding unit 302 restores an LPC coefficient from the input LPC coefficient quantization information and outputs the restored LPC coefficient to the synthesis filter 315 and the post-processing unit 316.

The structure of the gain value decoding unit 303 is determined by the gain value quantizer 129 of the coding apparatus. The gain value decoding unit 303 decodes the input gain value quantization information, which includes an adaptive codebook gain value and a fixed codebook gain value. Accordingly, an adaptive codebook gain value $g_p$ and a fixed codebook gain value $g_c$ in the base layer 100 are output from the gain value decoding unit 303.

The first fixed codebook decoding unit 304 decodes the input fixed codebook index of the base layer 100 and outputs the fixed codebook of the base layer 100. The fixed codebook decoding method is determined by the searching method of the fixed codebook searching unit 117 of the coding apparatus. The adaptive codebook decoding unit 305 decodes the input adaptive codebook index and outputs an adaptive codebook of the base layer 100.

The LPC coefficient decoding unit 302, the gain value decoding unit 303, the first fixed codebook decoding unit 304, and the adaptive codebook decoding unit 305 are defined as first decoding units that decode coding information of the base layer 100 transmitted from the demultiplexer 301.

The operations of the gain difference decoding unit 306 and the second fixed codebook decoding unit 307 are dependent on network traffic conditions and/or the processing capacity of a receiving terminal.

When it is determined that the gain difference decoding unit 306 and the second fixed codebook decoding unit 307 should operate, the gain difference decoding unit 306 decodes the input gain difference quantization information and the second fixed codebook decoding unit 307 decodes the input fixed codebook index of the speech quality enhancement layer. The gain difference decoding method is determined by the gain difference quantizer 134 of the coding apparatus and a decoding method performed in the second fixed codebook decoding unit 307 is determined by the second fixed codebook searching unit 131 of the coding apparatus.

The gain difference decoding unit 306 and the second fixed codebook decoding unit 307 are second decoding units that decode coding information of the speech quality enhancement layer 130 transmitted from the demultiplexer 301.

The first adder 308 adds the decoded fixed codebook gain value $g_c$ output from the gain value decoding unit 303 to a decoded gain difference $g_{diff}$ output from the gain difference decoding unit 306. The output of the first adder 308 is a gain value of the speech quality enhancement layer obtained through the decoding process.

The second adder 309 adds the decoded fixed codebook of the speech quality enhancement layer, which is decoded in the second fixed codebook decoding unit 307, to the decoded fixed codebook of the base layer, which is decoded in the first fixed codebook decoding unit 304. Accordingly, a signal output from the second adder 309 can be defined as $$c''(n)=c(n)+c'(n) \tag{14}$$

where c(n) represents the fixed codebook in the base layer, and c'(n) represents a fixed codebook in the speech quality enhancement layer.

Thus, a fixed codebook pulse in the decoding apparatus has a multi-size algebraic codebook pulse structure due to accumulation of the algebraic codebooks of the base layer and the speech quality enhancement layer. Accumulating the algebraic codebooks is for correcting defects caused when all pulses have the same magnitude. Thus, pulses of the accumulated algebraic codebooks have signs suitable for target signals.

The first selector switch 310 transmits, selectively, the fixed codebook gain value $g_c$ decoded in the gain value decoding unit 303 or the signal output from the first adder 308. That is, when the decoding apparatus operates in the base layer, the first selector switch 310 transmits the fixed codebook gain value $g_c$ output from the gain value decoding unit 303, and when the decoding apparatus operates in the speech quality enhancement layer, the first selector switch 310 transmits the gain value output from the first adder 308.

The second selector switch 311 transmits, selectively, the signal output from the second adder 309 or the fixed codebook of the base layer output from the first fixed codebook decoding unit 304. That is, when the decoding apparatus does not operate in the speech quality enhancement layer, the second selector switch 311 transmits the signal output from the first fixed codebook decoding unit 304. When the decoding apparatus operates in the speech quality enhancement layer, the second selector switch 311 transmits the signal output from the second adder 309.

The first multiplier 312 multiplies the fixed codebook output from the second selector switch 311 by the gain value output from the first selector switch 310, and outputs the result. The second multiplier 313 multiplies the decoded adaptive codebook output from the adaptive codebook decoding unit 305 by the adaptive codebook gain value $g_p$ output from the gain value decoding unit 303, and outputs the result. The third adder 314 adds the fixed codebook information output from the first multiplier 312 to the adaptive codebook information output from the second multiplier 313, and generates a restored excitation signal.

The first through third adders 308, 309, and 314, the first and second multipliers 312 and 313, and the first and second selector switches 310 and 311 are calculating units that calculate signals respectively decoded in the first decoding units and the second decoding units according to the operating environment of the decoding apparatus.

The synthesis filter 315 synthesizes the excitation signal output form the third adder 314 using the decoded LPC coefficient output from the LPC coefficient decoding unit 302, and restores the speech signal.

The post-processing unit 316 improves the quality of the speech signal transmitted from the synthesis filter 315. That is, to improve the quality of the speech signal, the post-processing unit 316 uses a high pass filter to filter the signal output from the synthesis filter 315, using the LPC coefficient output from the LPC coefficient decoding unit 302.

The synthesis filter 315 and the post-processing unit 316 are restoring units that restore a speech signal by synthesizing signals output from the calculating units with the LPC coefficient output from an LPC coefficient decoding unit 302.

Figure 4:
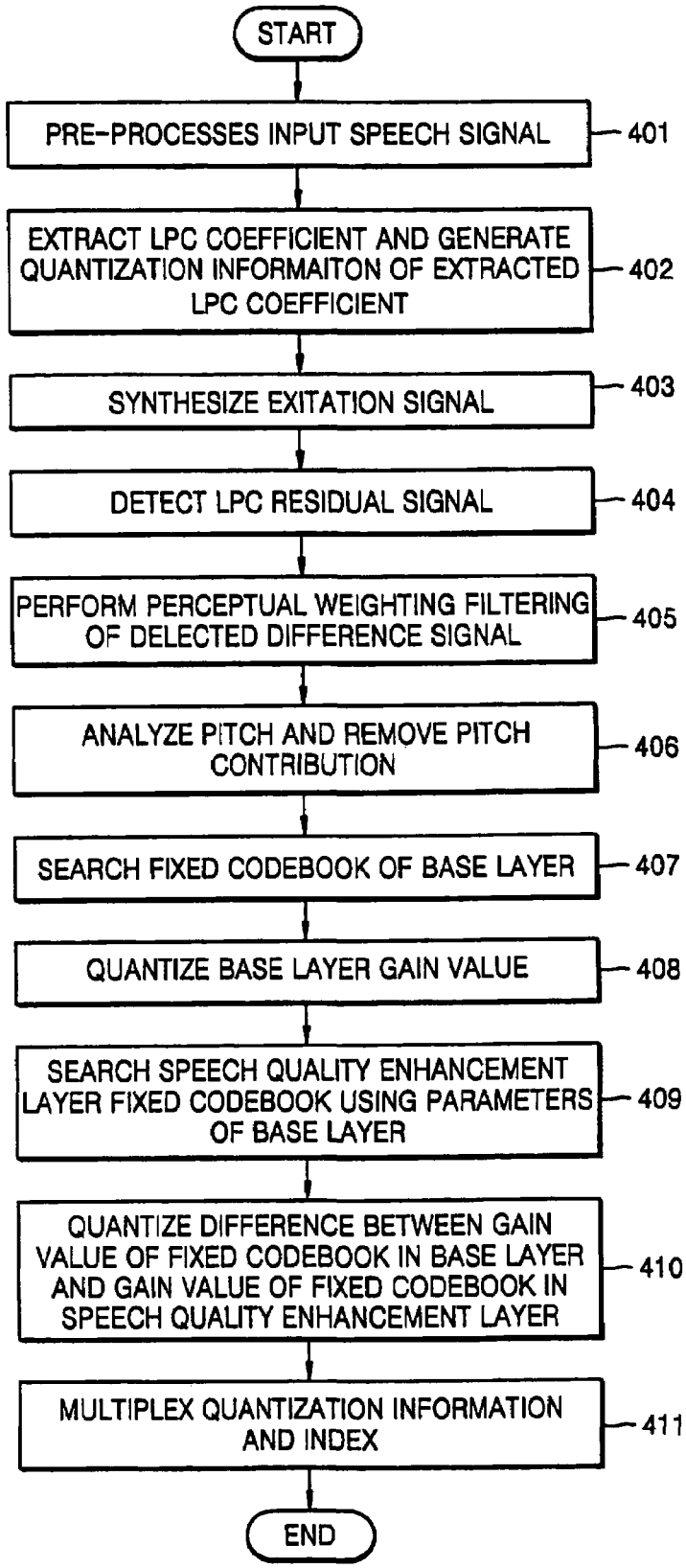
FIG. 4 is a flowchart of a bit rate scalable speech coding method according to an aspect of the invention.

FIG. 4 is a flowchart of a bit rate scalable speech coding method according to an aspect of the invention.

In operation 401, the speech signal coding apparatus preprocesses an input speech signal as in the pre-processing unit 102 shown in FIG. 1. In operation 402, the speech signal coding apparatus extracts the LPC coefficient from the preprocessed speech signal and generates quantization information of the extracted LPC coefficient.

In operation 403, the speech signal coding apparatus synthesizes an excitation signal using the generated LPC coefficient quantization information as in the synthesis filter 106. In operation 404, the speech signal coding apparatus subtracts the synthesized signal from the pre-processed signal to detect an LPC residual signal. In operation 405, the speech signal coding apparatus filters the detected LPC residual signal as in the perceptual weighting filter 110 and outputs a perceptual weighted signal.

In operation 406, the speech signal coding apparatus analyzes a pitch of the perceptual weighted signal as in the pitch analyzing unit 112 of FIG. 1 to obtain an index and a gain value of the adaptive codebook. The speech signal coding apparatus removes a pitch contribution from the perceptual weighted signal using the index of the adaptive codebook as in the pitch contribution removing unit 115 of FIG. 1 to detect a target signal necessary for a fixed codebook search.

In operation 407, the speech signal coding apparatus searches the fixed codebook of the base layer to generate a fixed codebook gain value and a fixed codebook index as in the first fixed codebook searching unit 117. In operation 408, the speech signal coding apparatus quantizes the detected fixed codebook gain value and the detected adaptive codebook gain value as in the gain value quantizer 129.

In operation 409, the speech signal coding apparatus searches the fixed codebook of the speech quality enhancement layer using parameters, i.e., correlations C and d(n), and energy E, of the base layer. A gain value and an index of the fixed codebook of the speech quality enhancement layer are respectively generated through the fixed codebook search of the speech quality enhancement layer.

In operation 410, the speech signal coding apparatus quantizes a difference between the gain value of the fixed codebook in the base layer and the gain value of the fixed codebook in the speech quality enhancement layer. The fixed codebook search and gain value quantization in the speech quality enhancement layer may be performed in multiple layers as described with reference to FIG. 1. If the fixed codebook search and gain value quantization in the speech quality enhancement layer are performed in multiple layers, the quality of restored speech signals can be improved further.

In operation 411, the speech signal coding apparatus multiplexes the LPC coefficient quantization information, the fixed codebook index of the base layer, the adaptive codebook index of the base layer, the fixed codebook gain value of the base layer, the adaptive codebook gain value of the base layer, the fixed codebook index of the speech quality enhancement layer, and the gain difference quantization information into bit streams and sends the bit streams to the speech signal decoding apparatus.

Figure 5:
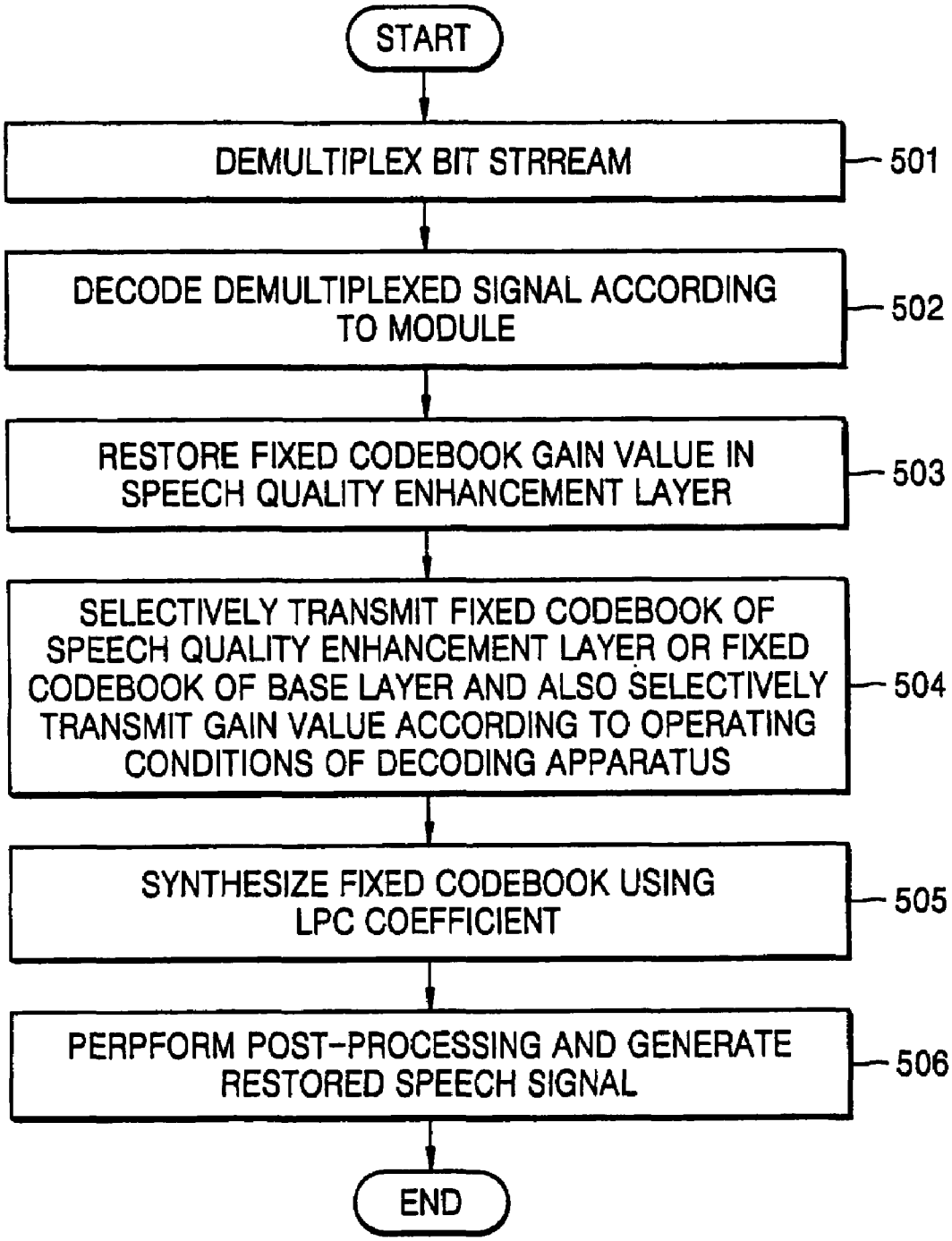
FIG. 5 is a flowchart of a bit rate scalable speech decoding method according to an aspect of the invention.

FIG. 5 is a flowchart of a bit rate scalable speech decoding method according to an aspect of the invention.

In operation 501, the speech signal decoding apparatus demultiplexes the bit stream into component information as in the demultiplexer 301 shown in FIG. 3.

In operation 502, the speech signal decoding apparatus decodes the demultiplexed signal. That is, the speech signal decoding apparatus decodes the demultiplexed signal as in the LPC coefficient decoding unit 302, the gain value decoding unit 303, the first fixed codebook decoding unit 304, the adaptive codebook decoding unit 305, the gain difference decoding unit 306, and the second speech quality enhancement layer fixed codebook decoding unit 307.

In operation 503, the speech signal decoding apparatus restores the fixed codebook gain value in the speech quality enhancement layer by performing a predetermined calculation. The speech signal decoding apparatus adds the decoded fixed codebook gain value to the gain difference value received as the quantization information of the fixed codebook gain value of the speech quality enhancement layer to restore the fixed codebook gain value of the speech quality enhancement layer.

In operation 504, the speech signal decoding apparatus transmits selectively the fixed codebook of the speech quality enhancement layer or the fixed codebook of the base layer and also transmits selectively the gain value, according to the operating conditions of the speech signal decoding apparatus. That is, when the speech signal decoding apparatus operates in the speech quality enhancement layer, the speech signal decoding apparatus transmits the fixed codebook of the speech quality enhancement layer, which is multiplied by the restored fixed codebook gain value of the speech quality enhancement layer. When the speech signal decoding apparatus does not operate in the speech quality enhancement layer, the speech signal decoding apparatus transmits the fixed codebook, which results from a multiplication of the decoded fixed codebook of the base layer by the fixed codebook gain value of the base layer.

In operation 505, the speech signal decoding apparatus synthesizes the codebook selectively transmitted in operation 504 using the LPC coefficient decoded in operation 502.

In operation 506, the speech signal decoding apparatus performs post-processing to generate a restored speech signal as in the post-processing unit 316.

Figure 6:
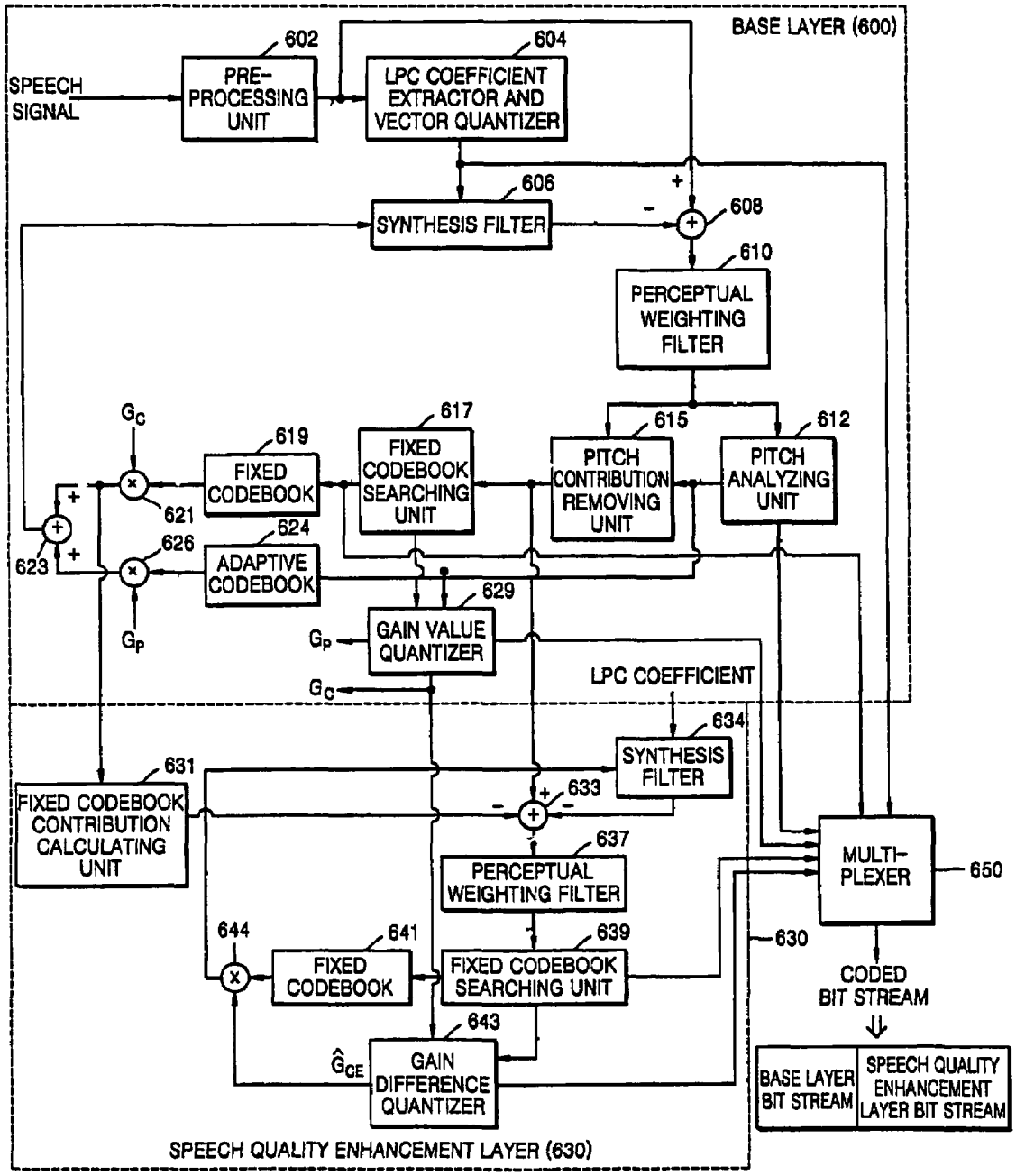
FIG. 6 is a block diagram of a bit rate scalable speech coding apparatus according to an aspect of the invention.

FIG. 6 is a block diagram of a bit rate scalable speech coding apparatus according to another aspect of the invention. Referring to FIG. 6, the bit rate scalable speech coding apparatus has a multi-layered fixed codebook structure including a base layer 600 and a speech quality enhancement layer 630.

The base layer 600 generates coding information for restoring the least speech quality. The base layer 600 is similar in configuration to the existing standard CELP speech codec. Accordingly, the base layer 600 filters an input speech signal using linear prediction coding and generates an excitation signal corresponding to the filtered speech signal. The excitation signal is generated through a fixed codebook search and an adaptive codebook search.

The base layer 600 includes a pre-processing unit 602, an LPC coefficient extractor and vector quantizer 604, a synthesis filter 606, a subtractor 608, a perceptual weighting filter 610, a pitch analyzing unit 612, a pitch contribution removing unit 615, a fixed codebook searching unit 617, a fixed codebook 619, a first multiplier 621, an adder 623, an adaptive codebook 624, a second multiplier 626, and a gain value quantizer 629.

The pre-processing unit 602 removes a DC component from the speech signal input. That is, the pre-processing unit 602 filters the input speech signal using a high pass filter to remove a noise component of a low frequency band of the input speech signal. The used high pass filter is the same as the high pass filter used by the pre-processing unit 102 of the base layer 100 illustrated in FIG. 1. A signal output from the pre-processing unit 602 is transmitted to the LPC coefficient extractor and vector quantizer 604.

The LPC coefficient extractor and vector quantizer 604 extracts an LPC coefficient of the signal output from the pre-processing unit 602. The extracted LPC coefficient is vector quantized by the LPC coefficient extractor and vector quantizer 604. Vector quantization information of the LPC coefficient is transmitted to the synthesis filter 606 and a multiplexer 650.

The synthesis filter 606 outputs a synthesized signal corresponding to an excitation signal using the vector quantization information of the LPC coefficient. The synthesized signal is output to the subtractor 608.

The subtractor 608 subtracts the synthesized signal from the signal output from the pre-processing unit 602 to generate an LPC residual signal. The LPC residual signal is transmitted to the perceptual weighting filter 610.

The perceptual weighting filter 610 maintains a quantizing noise below a masking threshold in order to use a masking effect of the human hearing organ. Thus, the perceptual weighting filter 610 outputs a signal including a weight for minimizing a quantizing noise of the LPC residual signal to the pitch analyzing unit 612.

The pitch analyzing unit 612 searches an open-loop pitch and a close-loop pitch of the signal output from the perceptual weighting filter 610. That is, the pitch analyzing unit 612 divides the signal output from the perceptual weighting filter 610 into a plurality of subframes, analyses a pitch of each subframe in the same manner as in the standard CELP speech coding apparatus, and outputs an index and a gain value of the adaptive codebook.

The index of the adaptive codebook is transmitted to the pitch contribution removing unit 615 and the adaptive codebook 624, and transmitted to the multiplexer 650. Further, the gain value of the adaptive codebook is provided to the gain value quantizer 629.

The pitch contribution removing unit 615 outputs a target signal necessary for the fixed codebook search from the signal output from the perceptual weighting filter 610 using the index of the adaptive codebook. The pitch contribution removing unit 615 subtracts a pitch contribution $y_1(n)$ from the signal output from the perceptual weighting filter 610 and outputs the target signal necessary for the fixed codebook search to the fixed codebook searching unit 617 of the base layer 600. The pitch contribution $y_1(n)$ is obtained by Equation (2).

The fixed codebook searching unit 617 obtains a correlation d(n) between the target signal and an impulse response h(n) using the target signal x'(n).

For example, if it is assumed that the size of a subframe is 40 samples, and the number of pulses of each layer is 4, the correlation d(n) can be defined as Equation 1.

The fixed codebook searching unit 617 searches a fixed codebook with an algebraic codebook structure as shown in Table 1 using the impulse response h(n) and the correlation d(n). Referring to Table 1, a magnitude of a pulse of fixed codebook vectors in the fixed codebook searching unit 117 is non-zero in only four positions. Accordingly, a correlation C that corresponds to the magnitude of the correlation d(n) can be defined as Equation (2) using a sign s of each pulse and the correlation d(n). The fixed codebook searching unit 617 detects the correlation C using Equation (2). The fixed codebook searching unit 617 detects energy E of the impulse response using Equation (3).

The fixed codebook searching unit 617 stores the correlation C and the energy E. Specifically, the fixed codebook searching unit 617 divides the correlation C into a sign[d(i)] and its absolute value and stores them. The sign[d(i)] is a sign of d(i). The energy E is stored as Equation (4). Equation (3) for the energy E can be rewritten as Equation (5).

If an index and a gain value of the fixed codebook are obtained through the search, the fixed codebook searching unit 617 transmits the fixed codebook index to the fixed codebook 619 and the multiplexer 650, and transmits the gain value to the gain value quantizer 629.

The fixed codebook 619 outputs a fixed codebook vector of the base layer 600 using the index input from the fixed codebook searching unit 617. The fixed codebook vector basically includes pulse position information m and sign information s. The fixed codebook vector output from the fixed codebook 619 is provided to the first multiplier 621.

The first multiplier 621 multiplies a quantized gain value $G_C$ corresponding to the gain value of the fixed codebook provided from the gain value quantizer 629 by the fixed codebook vector and outputs the result. The signal output can be defined as a fixed codebook $c_G(n)$ obtained by multiplying the quantized gain value $G_C$ by the fixed codebook vector of the base layer 600. The quantized gain value $G_C$ is provided from the gain value quantizer 629.

If the adaptive codebook index is applied, the adaptive codebook 624 outputs an adaptive codebook vector corresponding to the adaptive codebook index. The adaptive codebook vector is provided to the second multiplier 626.

The second multiplier 626 multiplies a quantized gain value $G_P$ corresponding to the gain value of the adaptive codebook by the adaptive codebook vector, and outputs the result. The quantized gain value $G_P$ is provided from the gain value quantizer 629.

The adder 623 adds the fixed codebook vector to the adaptive codebook vector and obtains an excitation signal. The excitation signal is output to the synthesis filter 606.

The gain value quantizer 629 quantizes the gain value of the fixed codebook output from the fixed codebook searching unit 617 and the gain value of the adaptive codebook output form the pitch analyzing unit 612. The quantized gain value $G_C$ corresponding to the gain value of the fixed codebook is output to the first multiplier 621, and the quantized gain value $G_P$ corresponding to the gain value of the adaptive codebook is output to the second multiplier 626. The quantized gain value $G_C$ is also provided to a gain difference quantizer 643 included in the speech quality enhancement layer 630.

The speech quality enhancement layer 630 provides additional bits to bits provided by the base layer 600 to improve the quality of restored speech, like the speech quality enhancement layer 130 shown in FIG. 1. Although FIG. 6 shows that one speech quality enhancement layer 630 is connected to the base layer 600 for the convenience of description, a plurality of speech quality enhancement layers can be connected to the base layer 600.

The speech quality enhancement layer 630 includes a fixed codebook contribution calculating unit 631, a third adder 633, a synthesis filter 634, a perceptual weighting filter 637, a fixed codebook searching unit 639, a fixed codebook 641, the gain difference quantizer 643, and a third multiplier 644.

When the fixed codebook contribution calculating unit 631 receives the fixed codebook $c_G(n)$ obtained by multiplying the quantized gain value $G_C$ by the fixed codebook vector output from the first multiplier 621 of the base layer 600, the fixed codebook contribution calculating unit 631 calculates a fixed codebook contribution $y_2(n)$ using Equation (15)

$$y_2(n) = \sum_{l=0}^{N-1} c_G(l)h(n-l) \tag{15}$$

where N is determined depending on the number of samples constituting each subframe. Accordingly, as described about the pitch contribution removing unit 615, when the size of a subframe is 40 samples, N is 40. In Equation 15, h(n) represents an impulse response of the synthesis filter. The fixed codebook contribution calculated by the fixed codebook contribution calculating unit 631 is provided to the third adder 633.

The third adder 633 outputs a signal obtained by removing the fixed codebook contribution and a synthesized signal from the synthesis filter 634 from the target signal necessary for the fixed codebook search of the base layer 600.

If the synthesis filter 634 receives the fixed codebook obtained by multiplying a fixed codebook vector by a quantized gain value $\hat{G}_{CE}$ of the speech quality enhancement layer 630, the synthesis filter 634 outputs a signal obtained by synthesizing the input fixed codebook signal using the LPC coefficient extracted and quantized by the LPC coefficient extractor and vector quantizer 604.

The perceptual weighting filter 637 filters a signal from the third adder 633 and outputs a target signal necessary for fixed codebook search in the speech quality enhancement layer 630, like the perceptual weighting filter 610. The target signal is transmitted to the fixed codebook searching unit 639.

The fixed codebook searching unit 639 searches the fixed codebook using the input target signal and obtains an index and a gain value of the fixed codebook, like the fixed codebook searching unit 617 of the base layer 600. The obtained index of the fixed codebook is transmitted to the multiplexer 650 and to the fixed codebook 641. The gain value $G_{CE}$ of the fixed codebook is transmitted to the gain difference quantizer 643.

The fixed codebook 641 outputs a fixed codebook vector of the speech quality enhancement layer 630 using the input fixed codebook index. The fixed codebook vector can include pulse position information m and sign information s. The fixed codebook vector output from the fixed codebook 641 is provided to the third multiplier 644. A pulse position of the fixed codebook vector output from the fixed codebook 619 of the base layer 600 may be the same as a pulse position of the fixed codebook vector output from the fixed codebook 641 of the speech quality enhancement layer 630.

The gain difference quantizer 643 quantizes the fixed codebook gain value $G_{CE}$ of the speech quality enhancement layer 630 using a log scale difference between the quantized gain value $G_C$ corresponding to the gain value of the fixed codebook output from the gain value quantizer 629 of the base layer 600 and the unquantized gain value $G_{CE}$ of the fixed codebook output from the fixed codebook searching unit 639 of the speech quality enhancement layer 630 to obtain a quantized gain value $\hat{G}_{CE}$, and outputs the quantized gain value $\hat{G}_{CE}$.

Figure 7:
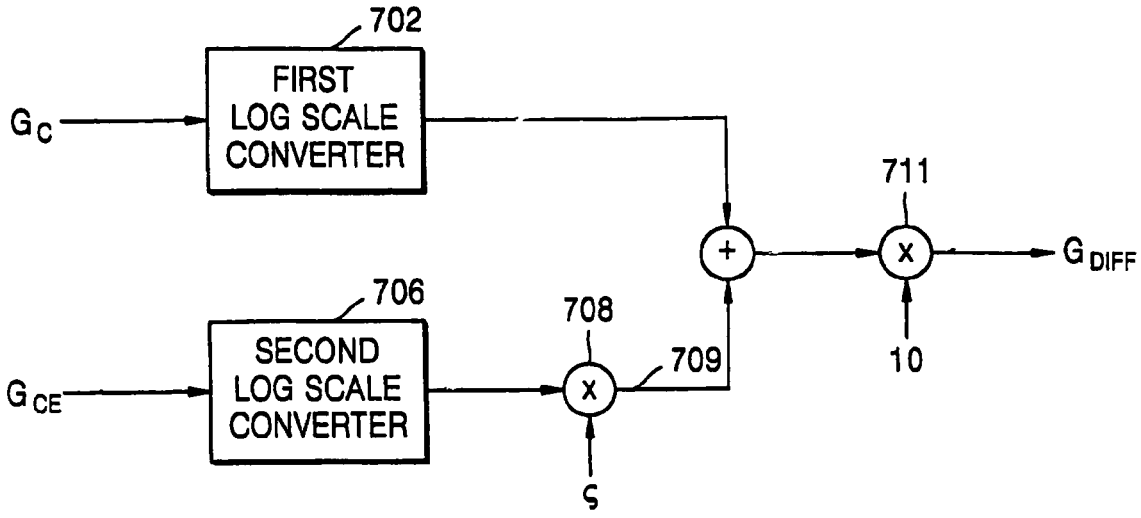
FIG. 7 is a block diagram of a gain difference quantizer of a speech quality enhancement layer in the bit rate scalable speech coding apparatus of FIG. 6.

FIG. 7 is a block diagram of an aspect of the gain difference quantizer 643. The gain difference quantizer 643 includes a first log scale converter 702, a second log scale converter 706, fourth and fifth multipliers 708 and 711, and a fourth adder 704.

If the quantized fixed codebook gain value $G_C$ provided by the gain value quantizer 629 of the base layer 600 is input to the first log scale converter 702, then the first log scale converter 702 outputs a log scale converted gain value of the fixed codebook corresponding to the fixed codebook gain value $G_C$.

The unquantized gain value $G_{CE}$ output from the fixed codebook searching unit 639 of the speech quality enhancement layer 630 is input to the second log scale converter 706 and the second log scale converter 706 outputs a log scale converted gain value of the fixed codebook.

The fourth multiplier 708 multiplies the log scale converted gain value of the fixed codebook input to the fourth multiplier 708 by a gain difference adjustment value ζ, and outputs the result.

The fourth adder 704 outputs a difference between the fixed codebook gain value and the fixed codebook gain value.

The fifth multiplier 711 multiplies the input gain difference by a scale factor 10 to generate a log scale gain difference $G_{DIFF}$ 712.

The operation of the gain difference quantizer 643 can be defined as $$G_{DIFF}=10\cdot(\log_{10}{}^{G_{C+1}}-\zeta\cdot\log_{10}{}^{G_{CE+1}}) \tag{16}$$

where $G_C$ represents the fixed codebook gain value quantized by the gain value quantizer 629 and $G_{CE}$ represents the unquantized gain value output from the fixed codebook searching unit 639. Further, the gain difference adjustment value ζ is an adjustment value for minimizing a dynamic range of the difference between the log scale gain values. The gain difference adjustment value ζ can be any value according to the kind of the speech codec, and for example, may be 0.987.

Since the log scale gain difference 712 generated through the calculation in Equation 16 is an analogue signal, it is quantized by a 3-bit scalar quantizer. The quantized fixed codebook gain value $\hat{G}_{CE}$ of the speech quality enhancement layer 630 is output using the quantization result of the 3-bit scalar quantizer. The quantized gain value $\hat{G}_{CE}$ is output to the third multiplier 644, and output to the multiplexer 650.

The third multiplier 644 multiplies the fixed codebook vector provided from the fixed codebook 641 by the quantized fixed codebook gain value $\hat{G}_{CE}$ of the speech quality enhancement layer 630 provided from the gain difference quantizer 643, and provides the result to the synthesis filter 634.

The multiplexer 650 multiplexes the LPC coefficient quantization information, the fixed codebook index, the adaptive codebook index, and the gain value quantization information, which are provided from the base layer 600, and the fixed codebook index and the gain difference quantization information, which are provided from the speech quality enhancement layer 630, and output the result as bit streams.

The bit streams of the base layer 600 and the speech quality enhancement layer 630 are separately transmitted. That is, as shown in FIG. 6, the bit stream of the speech quality enhancement layer 630 is transmitted following the bit stream of the base layer 600. Accordingly, the bit streams can be easily separated at a bit rate necessary for the decoding apparatus according to network traffic conditions. For example, in the case where channel characteristics of a channel of the decoding apparatus is so poor that the decoding apparatus can receive only the bit stream of the base layer, the decoding apparatus can only receive the bit stream of the base layer in the bit streams transmitted from the scalable speech coding apparatus of FIG. 6.

Figure 8:
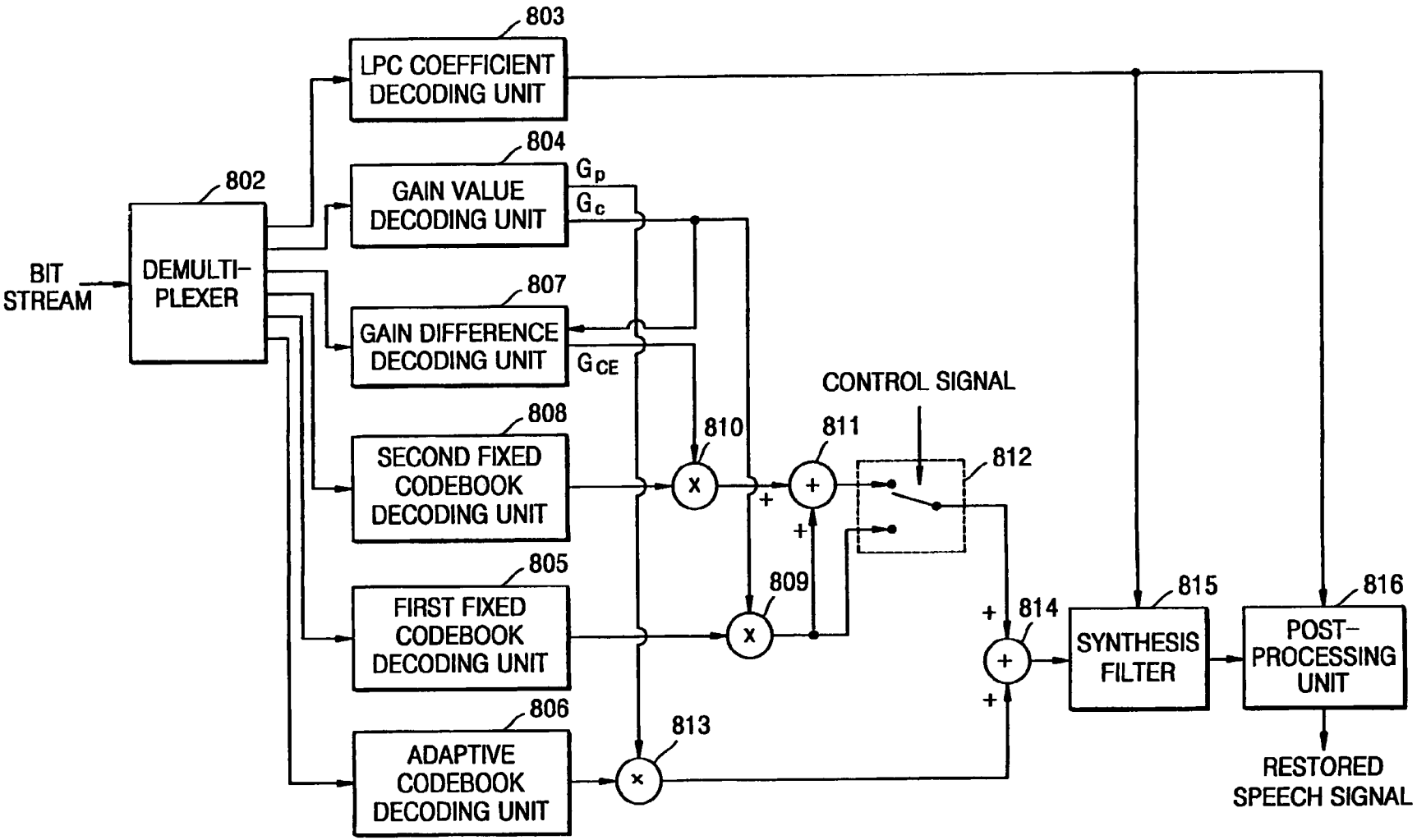
FIG. 8 is a block diagram of a bit rate scalable speech decoding apparatus according to an aspect of the invention.

FIG. 8 is a block diagram of a bit rate scalable speech decoding apparatus according to another aspect of the invention. Referring to FIG. 8, the bit rate scalable speech decoding apparatus includes a demultiplexer 802, an LPC coefficient decoding unit 803, a gain value decoding unit 804, a first fixed codebook decoding unit 805, an adaptive codebook decoding unit 806, a gain difference decoding unit 807, a second fixed codebook decoding unit 808, multipliers 809, 810, and 813, adders 811 and 814, a selector switch 812, a synthesis filter 815, and a post-processing unit 816.

The bit rate scalable speech decoding apparatus can selectively receive the bit stream transmitted from the bit rate scalable speech coding apparatus. That is, if the bit rate scalable speech signal decoding apparatus receives only the bit stream of the base layer in the bit streams, the decoding apparatus can restore the speech quality of the base layer. If the bit rate scalable speech signal decoding apparatus receives both the streams of the base layer and the speech quality enhancement layer, the decoding apparatus can provide further improved speech quality.

The demultiplexer 802 demultiplexes a received bit stream 801 into information of each element and outputs the result. That is, the demultiplexer 802 provides LPC coefficient quantization information to the LPC coefficient decoding unit 803, gain value quantization information to the gain value decoding unit 804, gain difference quantization information to the gain difference decoding unit 807, a fixed codebook index of the speech quality enhancement layer 630 to the second fixed codebook decoding unit 808, a fixed codebook index of the base layer 600 to the first fixed codebook decoding unit 805, and an adaptive codebook index to the adaptive codebook decoding unit 806.

The structure of the LPC coefficient decoding unit 803 is determined by the LPC coefficient extractor and vector quantizer 604 of the coding apparatus, and restores the LPC coefficient from the input LPC coefficient quantization information. The restored LPC coefficient is provided to the synthesis filter 815 and the post-processing unit 816.

The structure of the gain value decoding unit 804 is determined by the gain value quantizer 629 of the coding apparatus. The gain value decoding unit 804 decodes the input gain value quantization information. The gain value quantization information includes the adaptive codebook index value and the fixed codebook index value. Accordingly, the fixed codebook gain value $G_C$ and the adaptive codebook gain value $G_P$ of the base layer 600 are respectively output from the gain value decoding unit 804.

The first fixed codebook decoding unit 805 decodes the input first fixed codebook index and outputs the first fixed codebook. The fixed codebook decoding method is determined by the searching method of the fixed codebook searching unit 617 of the coding apparatus.

The adaptive codebook decoding unit 806 decodes the input adaptive codebook index and outputs an adaptive codebook.

The LPC coefficient decoding unit 803, the gain value decoding unit 804, the fixed codebook decoding unit 805, and the adaptive codebook decoding unit 806 can be defined as decoding units for decoding coding information in the base layer 600 transmitted from the demultiplexer 802.

The operation of the gain difference decoding unit 807 and the second fixed codebook decoding unit 808 is dependent on the network traffic conditions or the processing capacity of a receiving terminal.

If it is determined that the gain difference decoding unit 807 and the second fixed codebook decoding unit 808 operate, the gain difference decoding unit 807 decodes the input gain difference quantization information. The second fixed codebook decoding unit 808 decodes the input second fixed codebook index. The gain difference decoding method is determined by the gain difference quantizer of the coding apparatus.

The decoding method performed by the second codebook decoding unit 808 is determined by the second fixed codebook searching unit 631 of the coding apparatus. The gain difference decoding unit 807 and the second fixed codebook decoding unit 808 can be defined as decoding units for decoding coding information of the speech quality enhancement layer 630 transmitted from the demultiplexer 902.

The multiplier 809 multiplies the fixed codebook gain value $G_C$ of the base layer 600 restored by the gain value decoding unit 804 by the fixed codebook of the base layer output by the first fixed codebook decoding unit 805, and outputs a fixed codebook vector of the base layer.

The multiplier 810 multiplies the fixed codebook gain value $\hat{G}_{CE}$ of the speech quality enhancement layer 630 restored by the gain difference decoding unit 807 by the fixed codebook of the speech quality enhancement layer output by the second fixed codebook decoding unit 808 and outputs the fixed codebook vector of the speech quality enhancement layer.

The adder 811 adds the fixed codebook vector of the base layer output from the multiplier 809 to the fixed codebook vector of the speech quality enhancement layer output from the multiplier 810. Accordingly, a fixed codebook pulse of the decoding apparatus has a multi-size algebraic codebook pulse structure by accumulating of the algebraic codebooks of the base layer and the speech quality enhancement layer. The algebraic codebooks are accumulated to correct defects caused in a conventional fixed codebook structure where all pulses of fixed codebooks have the same size.

The selector switch 812 selectively transmits the signal output from the adder 811 or the fixed codebook vector of the base layer output form the multiplier 809. For example, when the decoding apparatus does not operate in the speech quality enhancement layer, the selector switch 812 selects and transmits the fixed codebook vector of the base layer output from the multiplier 809. When the coding apparatus operates in the speech quality enhancement layer, the selector switch 812 selects and transmits the signal output from the adder 811.

The multiplier 813 multiplies the decoded adaptive codebook output from the adaptive codebook decoding unit 806 by the gain value $G_P$ of the adaptive codebook output from the gain value decoding unit 804, and outputs an adaptive codebook vector.

The adder 814 adds the fixed codebook vector selected by the selector switch 812 to the adaptive codebook vector output from the multiplier 813 to generate a restored excitement signal.

The multiplier 810, the adder 811, and the selector switch 812 can be defined as calculating units for calculating the signals respectively decoded in the decoding units of decoding the coding information of the base layer and the speech quality enhancement layer according to the operating environment of the decoding apparatus.

The synthesis filter 815 restores the speech signal by synthesizing the excitement signal provided from the adder 814 using the restored LPC coefficient provided from the LPC coefficient decoding unit 803.

The post-processing unit 816 restores the speech signal transmitted from the synthesis filter 815. That is, to restore the speech signal, the post-processing unit 816 uses a high pass filter for filtering signals output from the synthesis filter 815 using the LPC coefficient provided from the LPC coefficient decoding unit 803.

The synthesis filter 815 and the post-processing unit 816 can be defined as restoring units for restoring the speech signal by synthesizing the signals output from the calculating units with the LPC coefficient output from the LPC coefficient decoding unit 803.

Figure 9:
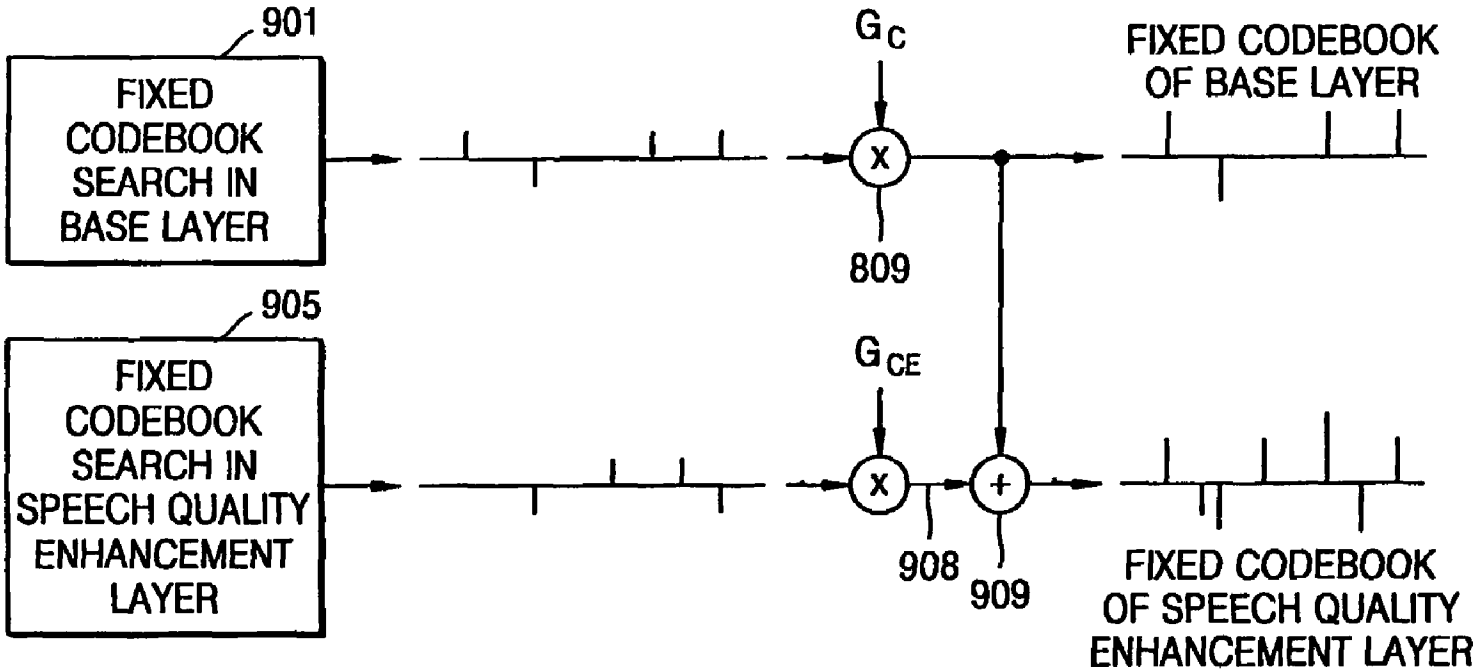
FIG. 9 is a diagram illustrating a pulse position searched by a fixed codebook searching unit of a base layer and a pulse position searched by a fixed codebook searching unit of a speech quality enhancement layer in the bit rate scalable speech decoding apparatus of FIG. 8.

FIG. 9 is a diagram for explaining the magnitude of a pulse restored in the speech signal decoding apparatus of FIG. 8 using a fixed codebook vector based on a pulse position searched through a fixed codebook search 901 of the base layer and a pulse position searched through fixed codebook search 905 of the speech quality enhancement layer in the speech signal coding apparatus of FIG. 6.

Referring to FIG. 9, the multiplier 809 multiplies a fixed codebook vector 902 provided from the first fixed codebook decoding unit 805 by a fixed codebook gain value $G_C$ provided from the gain value decoding unit 804 to generate a base layer fixed codebook vector 904.

The multiplier 810 multiplies a fixed codebook vector 906 provided from the second fixed codebook decoding unit 808 by a gain value $G_{CE}$ provided from the gain difference decoding unit 807 to generate a fixed codebook vector 908 of the speech quality enhancement layer. The adder 811 generates a fixed codebook vector 910 by adding the fixed codebook vector 908 of the speech quality enhancement layer to the fixed codebook vector 904 of the base layer.

The fixed codebook vector 904 of the base layer and the fixed codebook vector 908 of the speech quality enhancement layer are input to the adder 811, as shown in the pulse structure of FIG. 9, to generate a final fixed codebook 910 of the speech quality enhancement layer. Since the final fixed codebook 910 of the speech quality enhancement layer is obtained by adding the two fixed codebook vectors having different gain values, a multi-magnitude fixed codebook can be formed, thereby providing further improved speech quality.

Figure 10:
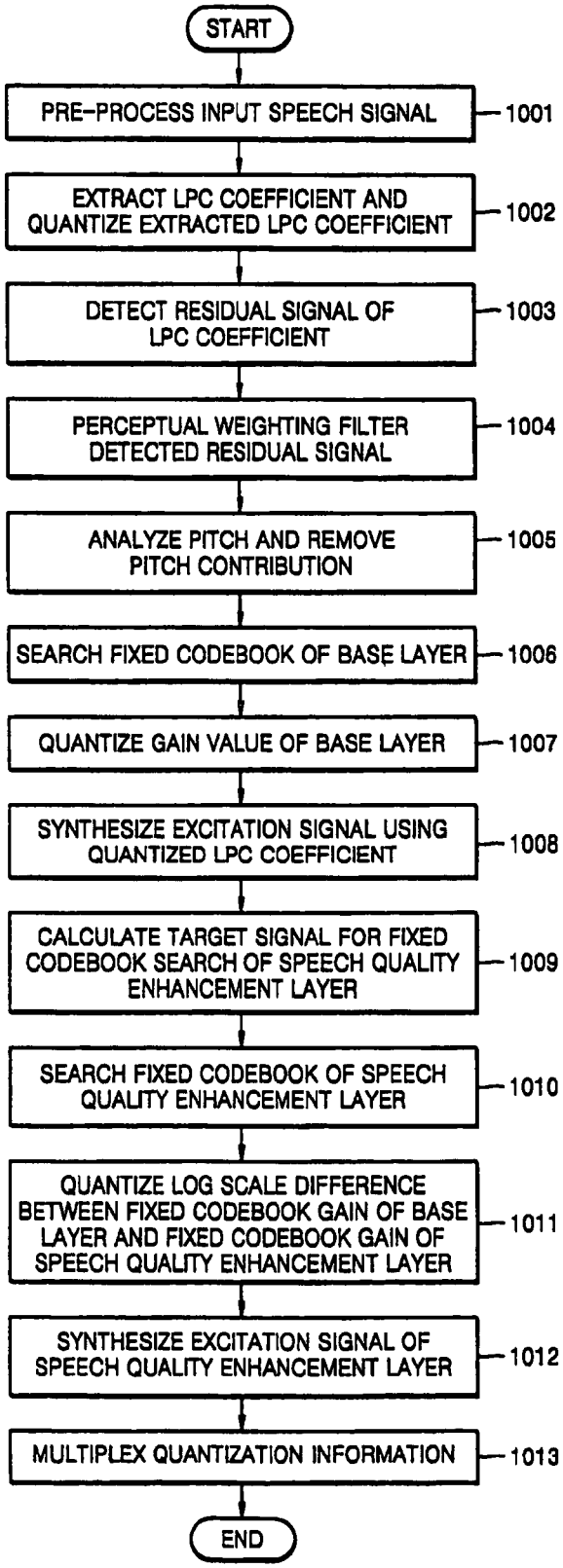
FIG. 10 is a flow chart of a bit rate scalable speech coding method according to an aspect of the invention.

FIG. 10 is a flow chart of a bit rate scalable speech coding method according to another aspect of the invention.

In operation 1001, the speech signal coding apparatus preprocesses an input speech signal as in the pre-processing unit 602 of FIG. 6. In operation 1002, the speech signal coding apparatus extracts an LPC coefficient from the pre-processed speech signal and generates quantization information of the extracted LPC coefficient.

In operation 1003, the speech signal coding apparatus detects a residual signal of the LPC coefficient from the pre-processed signal through the synthesis filter 606. In operation 1004, the speech signal coding apparatus filters the detected residual signal and outputs a perceptual weighted signal as in the perceptual weighting filter 610 of FIG. 6.

In operation 1005, the speech signal coding apparatus analyzes a pitch of the perceptual weighted signal as in the pitch analyzing unit 612 of FIG. 6, removes a pitch contribution from the perceptual weighted signal using the analysis result as in the pitch contribution removing unit 615 of FIG. 6, and generates a gain value and an index of the adaptive codebook.

In operation 1006, the speech coding apparatus searches the fixed codebook of the base layer to generate a gain value and an index of the fixed codebook as in the fixed codebook searching unit 617 of the base layer 600 of FIG. 6.

In operation 1007, the speech signal coding apparatus quantizes the detected fixed codebook gain value and the detected adaptive codebook gain value as in the gain value quantizer 629 of FIG. 6.

In operation 1008, the speech signal coding apparatus synthesizes a fixed codebook vector generated in the base layer 600 with an excitation signal of an adaptive codebook vector using the vector quantized LPC coefficient as in the synthesis filter 606 of FIG. 6.

In operation 1009, the speech signal coding apparatus generates a target signal for fixed codebook search, as in the fixed codebook searching unit 639 of FIG. 6, by removing the contribution of a target signal for the fixed codebook search in the base layer 600 and a previous LPC synthesized signal of the speech quality enhancement layer 630 from the target signal of the base layer 600. That is, the target signal in the speech quality enhancement layer is obtained by removing the fixed codebook contribution of the base layer and the previous LPC synthesized signal detected in the speech quality enhancement layer 630 from the target signal detected in the base layer 600.

In operation, 1010, the speech signal coding apparatus performs fixed codebook search of the speech quality enhancement layer 630 using the target signal detected in operation 1009 to generate a fixed codebook gain value of the speech quality enhancement layer and a fixed codebook index of the speech quality enhancement layer.

In operation 1011, the speech signal coding apparatus quantizes a log scale difference between a quantized fixed codebook gain value and the unquantized fixed codebook gain value of the base layer. The fixed codebook search and the gain value quantization in the speech quality enhancement layer can be performed in multiple layers as a plurality of speech quality enhancement layers are provided. If the operation of the speech quality enhancement layers is performed in multiple layers, the quality of restored speech signals can be further improved.

In operation 1012, the speech signal coding apparatus passes a fixed codebook vector (or an excitation signal) generated in the speech quality enhancement layer through the synthesis filter 634 of FIG. 6 and outputs a synthesized signal.

In operation 1013, the speech signal coding apparatus multiples the LPC coefficient quantization information, the fixed codebook index of the base layer, the adaptive codebook index of the base layer, the gain value of the fixed codebook of the base layer, the gain value of the adaptive codebook of the base layer, the fixed codebook index of the speech quality enhancement layer, and the gain difference quantization information to obtain bit streams and outputs the bit streams to the speech signal decoding apparatus.

Figure 11:
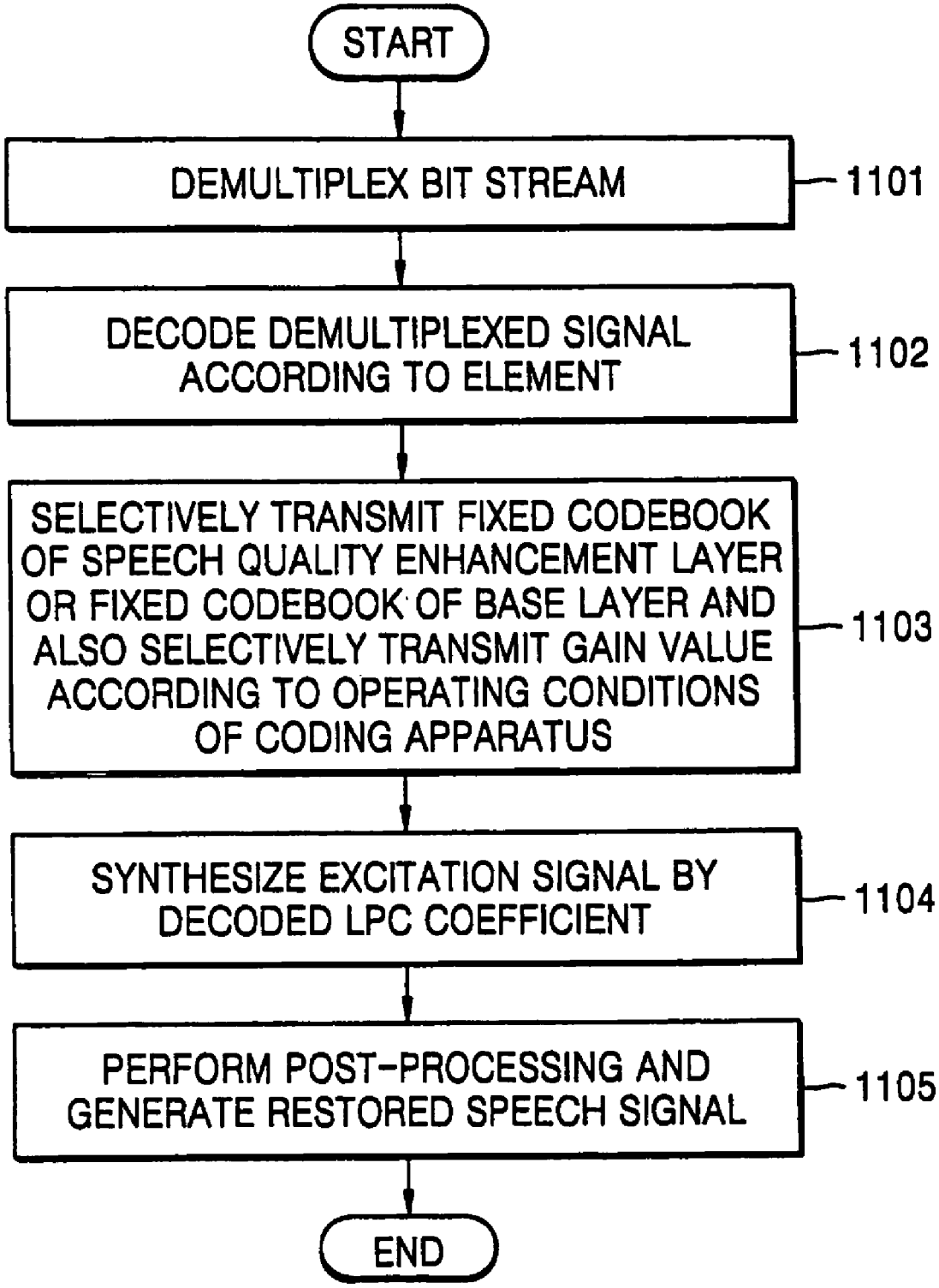
FIG. 11 is a flow chart of a bit rate scalable speech decoding method according to an aspect of the invention.

FIG. 11 is a flow chart of a bit rate scalable speech decoding method according to another aspect of the invention.

In operation 1101, the speech signal decoding apparatus demultiplexes the received bit stream into information of each element as in the multiplexer 802 of FIG. 8.

In operation 1102, the speech signal decoding apparatus decodes the demultiplexed signal. That is, the speech signal decoding apparatus decodes the demultiplexed signal as in the LPC coefficient decoding unit 803, the gain value decoding unit 804, the first fixed codebook decoding unit 805, the adaptive codebook decoding unit 806, the gain difference decoding unit 807, and the second fixed codebook decoding unit 808 of FIG. 8.

In operation 1103, the speech signal decoding apparatus selectively transmits the fixed codebook of the speech quality enhancement layer or the fixed codebook of the base layer according to the operating conditions of the speech signal decoding apparatus, and also selectively transmits the gain value. That is, if the speech signal decoding apparatus operates in the speech quality enhancement layer, the speech signal decoding apparatus adds the fixed codebook, which is obtained by multiplying the restored fixed codebook of the speech quality enhancement layer by the restored gain value of the fixed codebook of the speech quality enhancement layer to the signal, which is obtained by multiplying the fixed codebook of the base layer by the gain value of the fixed codebook of the base layer, and transmits the result. Meanwhile, if the speech signal coding apparatus does not operate in the speech quality enhancement layer, the speech signal decoding apparatus transmits the fixed codebook obtained by multiplying the decoded fixed codebook of the base layer by the gain value of the fixed codebook of the base layer.

In operation 1104, the speech signal decoding apparatus synthesizes the fixed codebook selectively transmitted in operation 1103 using the LPC coefficient decoded in operation 1102.

In operation 1105, the speech signal decoding apparatus generates a restored speech signal by performing post-processing, similar to the post-processing unit 816.

As described above, since the invention provides a bit rate scalable structure without changing the existing standard CELP speech codec, the invention is compatible with a system using the existing standard CELP speech codec.

Furthermore, according to an aspect of the invention, since the target signal for the fixed codebook search of the base layer is the same as the target signal for the fixed codebook search of the speech quality enhancement layer, the codebook searched in the speech quality enhancement layer is not stored for a next frame, and accordingly, does not affect the operation of the base layer.

Further, since the fixed codebook search of the speech quality enhancement layer uses the parameters obtained during the fixed codebook search of the base layer, the number of calculations required for the fixed codebook search in the speech quality enhancement layer is reduced.

Moreover, according to another aspect of the invention, since the target signal necessary for the fixed codebook search of the speech quality enhancement layer is obtained by removing the fixed codebook contribution of the base layer and the synthesized signal of the fixed codebook of the previous speech quality enhancement layer provided through the synthesis filter of the speech quality enhancement layer from the fixed codebook target signal of the base layer, the fixed codebook search can be performed using the target signal for only the speech quality enhancement layer, thereby achieving exacter fixed codebook search.

In addition, since the pulse position searched by the speech quality enhancement layer and the pulse position searched by the base layer can be the same, the pulses of the algebraic codebook do not need to have the same size, and the pulses of the final fixed codebook can have a multiple magnitude, thereby improving the quality of restored speech signal.

Additionally, since the quantized value of the difference, which has a relatively narrower dynamic range, between the gain value of the base layer and the gain value of the speech quality enhancement layer is used as the gain value of the speech quality enhancement layer, the number of bits necessary for quantizing the gain value of the speech quality enhancement layer can be reduced.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A speech signal coding apparatus comprising:

a base layer filtering an input speech signal using linear prediction coding and generating an excitation signal corresponding to the filtered input speech signal through a fixed codebook searching unit and an adaptive codebook search;

one or more speech quality enhancement layers searching a fixed codebook using parameters obtained by the fixed codebook searching unit of the base layer; and a multiplexer multiplexing signals generated by the base layer and the one or more speech quality enhancement layers and outputting a multiplexed signal, wherein the parameters comprise:

a first correlation d(n) between an impulse response h(i-n) and a target signal x'(n) obtained in the fixed codebook searching unit in the base layer by the following equation, $$d(n) = \sum_{i=n}^{39} x'(n)h(i-n) \quad n = 0, \ldots, 39;$$

a second correlation C detected by using a sign s of each pulse and the first correlation d(n) by the following equation, $$C = \sum_{i=0}^{3} s_1 d(m_i) = |d(m_0)| + |d(m_1)| + |d(m_2)| + |d(m_3)|,$$

wherein $m_i$ represents an $i^{th}$ pulse position, and $s_i$ represents a sign of an $i^{th}$ pulse; and an amount of energy E of the impulse response h(n) detected by the following equation, $$E = \sum_{i=0}^{3} \phi(m_i, m_j) + 2\sum_{i=0}^{2} \sum_{j=i+1}^{3} s_i s_j \phi(m_i m_j),$$

wherein $\Phi(m_i, m_j)$ represents a correlation between the impulse response h(n) with respect to $i^{th}$ and $j^{th}$ pulse positions, $s_i$ is the sign of an $i^{th}$ pulse, and $s_j$ is a sign of a $j^{th}$ pulse.

2. The speech signal coding apparatus of claim 1, wherein the fixed codebook searching unit in the base layer and the fixed codebook search in the one or more speech quality enhancement layers are performed using an algebraic codebook.

3. The speech signal coding apparatus of claim 1, wherein the one or more speech quality enhancement layers each quantize a difference between a first gain value obtained through the fixed codebook searching unit in the base layer and a second gain value obtained by the fixed codebook search performed by the one or more speech quality enhancement layers.

4. The speech signal coding apparatus of claim 1, wherein the multiplexer multiplexes:

linear prediction coding coefficient quantization information, a fixed codebook index in the base layer, an adaptive codebook index in the base layer, quantization information for a fixed codebook gain value in the base layer, quantization information for an adaptive codebook gain value in the base layer; and a fixed codebook index in the one or more speech quality enhancement layers, and quantization information regarding the difference between the fixed codebook gain value in the base layer and a fixed codebook gain value in the one or more speech quality enhancement layers.

5. The speech signal coding apparatus of claim 1, wherein the one or more speech quality enhancement layers comprises a plurality of speech quality enhancement layers and the multiplexer multiplexes quantization information regarding the difference between the fixed codebook gain values and fixed codebook indexes, which are output from the plurality of speech quality enhancement layers.

6. A speech signal decoding apparatus decoding a speech signal coded by a base layer and at least one speech quality enhancement layer, the speech signal decoding apparatus comprising:

a first decoding unit decoding coding information in the base layer from the coded speech signal;

a second decoding unit decoding coding information in the speech quality enhancement layer from the coded speech signal according to an operating environment of the speech signal decoding apparatus, wherein the coding information in the speech quality enhancement is obtained by searching a fixed codebook using parameters obtained by the fixed codebook searching unit of the base layer, wherein the parameters comprise:

a first correlation d(n) between an impulse response h(i-n) and a target signal x'(n) obtained in the fixed codebook searching unit in the base layer by the following equation, $$d(n) = \sum_{i=n}^{39} x'(n)h(i-n) \quad n = 0, \ldots, 39;$$

a second correlation C detected by using a sign s of each pulse and the first correlation d(n) by the following equation, $$C = \sum_{i=0}^{3} s_1 d(m_i) = |d(m_0)| + |d(m_1)| + |d(m_2)| + |d(m_3)|,$$

wherein $m_i$ represents an $i^{th}$ pulse position, and $s_i$ represents a sign of an $i^{th}$ pulse; and an amount of energy E of the impulse response h(n) detected by the following equation—, $$E = \sum_{i=0}^{3} \phi(m_i, m_j) + 2\sum_{i=0}^{2} \sum_{j=i+1}^{3} s_i s_j \phi(m_i m_j),$$

wherein $\Phi(m_i, m_j)$ represents a correlation between the impulse response h(n) with respect to $i^{th}$ and $j^{th}$ pulse positions, $s_i$ is the sign of an $i^{th}$ pulse, and $s_j$ is a sign of a $j^{th}$ pulse;

a calculating unit calculating a signal output from the first decoding unit and a signal output from the second decoding unit, according to the operating environment of the speech signal decoding apparatus; and a speech signal restoring unit synthesizing a signal output from the calculating unit using a linear prediction coding coefficient output from the first decoding unit and restoring the speech signal, wherein the first decoding unit comprises a linear prediction coding coefficient decoding unit decoding linear prediction coding coefficient quantization information included in the coding information in the base layer;

a first fixed codebook decoding unit decoding a fixed codebook index included in the coding information in the base layer;

an adaptive codebook decoding unit decoding an adaptive codebook index included in the coding information in the base layer; and a gain value decoding unit decoding a fixed codebook gain value and an adaptive codebook gain value included in the coding information in the base layer, and the second decoding unit comprises a gain difference decoding unit decoding quantization information regarding a difference between fixed codebook gain values included in the coding information in the speech quality enhancement layer; and a second fixed codebook decoding unit decoding a fixed codebook index included in the coding information in the speech quality enhancement layer.

7. The speech signal decoding apparatus of claim 6, wherein the calculating unit comprises:

a first adder adding the decoded fixed codebook gain value output from the gain value decoding unit to the decoded gain difference output from the gain difference decoding unit;

a first selector transmitting the decoded fixed codebook gain value output from the gain value decoding unit or a gain value output from the first adder according to operating conditions of the speech signal decoding apparatus;

a second adder adding a decoded fixed codebook of the speech quality enhancement layer output from the second fixed codebook decoding unit to a decoded fixed codebook of the base layer output from the first fixed codebook decoding unit;

a second selector switch transmitting a signal output from the second adder or the decoded fixed codebook output from the first fixed codebook decoding unit according to the operating conditions of the speech signal decoding apparatus;

a first multiplier multiplying a decoded adaptive codebook output from the adaptive codebook decoding unit by a decoded adaptive codebook gain value output from the gain value decoding unit;

a second multiplier multiplying a signal output from the first selector switch by a signal output from the second selector switch; and a third adder adding a signal output from the first multiplier to a signal output from the second multiplier.

8. The speech signal decoding apparatus of claim 7, wherein the speech signal restoring unit comprises:

a synthesis filter synthesizing a signal output from the third adder using the linear prediction coding coefficient; and a post-processing unit obtaining the restored speech signal using a signal output from the synthesis filter and the linear prediction coding coefficient.

9. The speech signal decoding apparatus of claim 6, wherein the second decoding unit comprises:

a gain difference decoding unit decoding quantization information regarding a difference between gain values of the fixed codebook included in the coding information in the speech quality enhancement layer; and a fixed codebook decoding unit decoding a fixed codebook index included in the coding information in the speech quality enhancement layer.

10. The speech signal decoding apparatus of claim 6, wherein the second decoding unit comprises:

a gain difference decoding unit decoding quantization information regarding a difference between log scale gain values of the fixed codebook included in the coding information of the speech quality enhancement layer; and a fixed codebook decoding unit decoding a fixed codebook index included in the coding information of the speech quality enhancement layer.

11. The speech signal decoding apparatus of claim 10, wherein the calculating unit comprises:

a first adder adding a decoded fixed codebook of the speech quality enhancement layer output from the second fixed codebook decoding unit to a decoded fixed codebook of the base layer output from the first fixed codebook decoding unit;

a selector switch selectively transmitting a signal output from the first adder or a decoded fixed codebook of the base layer output from the first fixed codebook decoding unit according to operating conditions of the speech signal decoding apparatus; and a second adder adding a signal output from the selector switch to a decoded adaptive codebook of the base layer output from the adaptive codebook decoding unit.

12. The speech signal decoding apparatus of claim 11, wherein the speech signal restoring unit comprises:

a synthesis filter synthesizing a signal output from the second adder using the linear prediction coding coefficient; and a post-processing unit obtaining a restored speech signal using the linear prediction coding coefficient and a signal output from the synthesis filter.

13. The speech signal decoding apparatus of claim 6, wherein the second decoding unit comprises:

a gain difference decoding unit decoding a difference between fixed codebook log scale gain values included in the coding information in the speech quality enhancement layer; and a fixed codebook decoding unit decoding a fixed codebook index included in the coding information of the speech quality enhancement layer.

14. A method of decoding a speech signal coded by a base layer and by at least one speech quality enhancement layer, the method comprising:

decoding the coded speech signal;

selectively transmitting one of a codebook of the base layer and a codebook of the speech quality enhancement layer, which are decoded in the decoding of the coded speech signal, according to an operating condition, wherein coding information in the speech quality enhancement layer is obtained by searching a fixed codebook using parameters obtained by a fixed codebook searching unit in the base layer, wherein the parameters comprise:

a first correlation d(n) between an impulse response h(i-n) and a target signal x'(n) obtained in the fixed codebook searching unit in the base layer by the following equation, $$d(n) = \sum_{i=n}^{39} x'(n)h(i-n) \quad n = 0, \ldots, 39;$$

a second correlation C detected by using a sign s of each pulse and the first correlation d(n) by the following equation, $$C = \sum_{i=0}^{3} s_1 d(m_i) = |d(m_0)| + |d(m_1)| + |d(m_2)| + |d(m_3)|,$$

wherein $m_i$ represents an $i^{th}$ pulse position, and $s_i$ represents a sign of an $i^{th}$ pulse; and an amount of energy E of the impulse response h(n) detected by the following equation, $$E = \sum_{i=0}^{3} \phi(m_i, m_j) + 2\sum_{i=0}^{2} \sum_{j=i+1}^{3} s_i s_j \phi(m_i m_j),$$

wherein $\Phi(m_i,m_j)$ represents a correlation between the impulse response h(n) with respect to $i^{th}$ and $j^{th}$ pulse positions, $s_i$ is the sign of an $i^{th}$ pulse, and $s^j$ is a sign of a $j^{th}$ pulse; and generating a restored speech signal by synthesizing the selectively transmitted codebook with a linear prediction coding coefficient, which is decoded in the decoding of the coded speech signal, wherein the decoding the coded speech signal further comprises demultiplexing the coded speech signal into coding information of the base layer and coding information of the speech quality enhancement layer and decoding the demultiplexed coding information, and restoring a gain value of the fixed codebook in the speech quality enhancement layer by adding a difference between a decoded fixed codebook gain value in the base layer and a decoded fixed codebook gain value in the at least one speech quality enhancement layer.

15. A speech signal coding apparatus comprising:

a base layer filtering an input speech signal using linear prediction coding, and generating an excitation signal of the filtered input speech signal through a fixed codebook search and an adaptive codebook search;

at least one speech quality enhancement layer searching a fixed codebook using a target signal, which is obtained by removing a contribution of a fixed codebook of the base layer from a target signal for the fixed codebook search of the base layer; and a multiplexer multiplexing signals generated in the base layer and the speech quality enhancement layer, and outputting a multiplexed signal, wherein the fixed codebook contribution $y_2(n)$ of the base layer is calculated by the following equation using a fixed codebook $C_G$ by which a quantized gain value of the fixed codebook of the base layer is multiplied and an impulse response h(n) of a synthesis filter:

$$y_2(n) = \sum_{l=0}^{N-1} c_G(l)h(n-l),$$

the speech quality enhancement layer further comprises multiplying a fixed codebook vector obtained through the fixed codebook search of the speech quality enhancement layer by a quantized gain value of the speech quality enhancement layer, which is obtained by quantizing a difference between a log scale value of a first gain value obtained through the fixed codebook search of the base layer and a log scale value of a second gain value obtained through the fixed codebook search of the speech quality enhancement layer.

16. The speech signal coding apparatus of claim 15, wherein the speech quality enhancement layer further removes a signal, which is obtained by synthesizing a fixed codebook signal generated in the speech quality enhancement layer using the linear prediction coding coefficient, from the target signal of the base layer.

17. The speech signal coding apparatus of claim 15, wherein when there is more than one speech quality enhancement layer, the multiplexer multiplexes quantization information regarding a difference between log scale gain values of the fixed codebook and fixed codebook indexes, which are output from each quality enhancement layer.

18. The speech signal coding apparatus of claim 15, wherein the speech quality enhancement layer filters the target signal with a perceptual weighting filter, before performing the fixed codebook search.

19. A data signal coding apparatus for coding data having a multilayered codebook structure, comprising:

a first layer filtering an input data signal using linear prediction coding and generating a data signal corresponding to the restored input data signal using a codebook table;

a second layer to receive the data signal from the first layer, search a codebook using parameters of the data signal, and provide additional data to the first layer to enhance a quality of restored data; and a multiplexer to multiplex data generated from both the first layer and the second layer to obtain bit streams, wherein the bit stream of the second layer is transmitted following the bit stream of the first layer, such that the respective bit streams are separated at a bit rate necessary for a decoding apparatus in a network according to network traffic conditions, the generating the data signal corresponding to the restored input data signal using the codebook table of the first layer includes conducting a fixed codebook search and an adaptive codebook search, and the second layer further quantizes a difference between a first gain value obtained through the fixed codebook search performed by the first layer and a second gain value obtained by the fixed codebook search performed by the second layer, wherein the parameters include a first correlation d(n) between an impulse response h(i-n) and a target signal x'(n) obtained in the fixed codebook searching unit in the base layer by the following equation, $$d(n) = \sum_{i=n}^{39} x'(n)h(i-n) \quad n = 0, \ldots, 39$$

a second correlation C detected by using a sign s of each pulse and the first correlation d(n) by the following equation, $$C = \sum_{i=0}^{3} s_1 d(m_i) = |d(m_0)| + |d(m_1)| + |d(m_2)| + |d(m_3)|,$$

wherein $m_i$ represents an $i^{th}$ pulse position, and $s_i$ represents a sign of an $i^{th}$ pulse, and an amount of energy E of the impulse response h(n) detected by the following equation, $$E = \sum_{i=0}^{3} \phi(m_i, m_j) + 2\sum_{i=0}^{2} \sum_{j=i+1}^{3} s_i s_j \phi(m_i m_j),$$

wherein $\Phi(m_i, m_j)$ represents a correlation between the impulse response h(n) with respect to $i^{th}$ and $j^{th}$ pulse positions, $s_i$ is the sign of an $i^{th}$ pulse, and $s_j$ is a sign of a $j^{th}$ pulse.

20. The data signal coding apparatus as claimed in claim 19, wherein the data is speech.

21. The data signal coding apparatus as claimed in claim 19, further comprising additional second-layers to receive coding data from the first layer and provide additional data to the first layer to enhance the quality of restored data.

22. The data signal coding apparatus of claim 21, wherein when the additional second-layers to receive coding data from the first layer are used, the multiplexer multiplexes quantization data regarding a difference between the fixed codebook gain values and fixed codebook indexes, which are output from each of the additional second-layers.

23. The data signal coding apparatus as claimed in claim 19, wherein the second layer is a speech quality enhancement layer.

24. The data signal coding apparatus as claimed in claim 19, wherein the bit streams of the data from the first layer and the second layer are separately transmitted.

25. A data signal coding method of coding data using a coder having a multilayered fixed codebook structure, comprising:

extracting a linear prediction coding coefficient from an input data signal and generating a data signal corresponding to the input data signal by searching codebooks, in a first layer, wherein the generating the data signal corresponding to the restored input data signal using the codebook table of the first layer includes conducting a fixed codebook search and an adaptive codebook search;

searching a codebook using parameters of the data signal and providing additional data to enhance a quality of restored data, in a second layer;

obtaining bit streams of data by multiplexing data generated from both the first layer and the second layer;

transmitting the bit stream of the second layer following the bit stream of the first layer, such that the respective bit streams are separated at a bit rate necessary for a decoding apparatus in a network according to network traffic conditions;

searching respective codebooks of additional second layers using parameters of the data signal and providing additional data to enhance the quality of restored data, wherein when the additional second-layers to receive coding data from the first layer are used, quantization data regarding a difference between the fixed codebook gain values and fixed codebook indexes are multiplexed, the quantization data is output from each of the additional second-layers, wherein the parameters comprise:

a first correlation d(n) between an impulse response h(i-n) and a target signal x'(n) obtained by the fixed codebook search of the base layer by the following equation, $$d(n) = \sum_{i=n}^{39} x'(n)h(i-n) \quad n = 0, \ldots, 39$$

a second correlation C detected by using a sign s of each pulse and the first correlation d(n) by the following equation, $$C = \sum_{i=0}^{3} s_1 d(m_i) = |d(m_0)| + |d(m_1)| + |d(m_2)| + |d(m_3)|,$$

wherein $m_i$ represents an $i^{th}$ pulse position, and $s_i$ represents a sign of an $i^{th}$ pulse; and an amount of energy E of the impulse response h(n) detected by the following equation, $$E = \sum_{i=0}^{3} \phi(m_i, m_j) + 2\sum_{i=0}^{2} \sum_{j=i+1}^{3} s_i s_j \phi(m_i m_j),$$

wherein $\Phi(m_i, m_j)$ represents a correlation between the impulse response h(n) with respect to $i^{th}$ and $j^{th}$ pulse positions, $s_i$ is the sign of an $i^{th}$ pulse, and $s_j$ is a sign of a $j^{th}$ pulse.

26. The data signal coding method as claimed in claim 25, wherein the second layer is a speech quality enhancement layer.

27. The data signal coding method as claimed in claim 25, further comprising separately transmitting the bit streams of the data from the first layer and the second layer.

28. The data signal coding method as claimed in claim 25, wherein the data is speech.

* * * * *

UNITED STATES PATENT AND TRADEMARK OFFICE

CERTIFICATE OF CORRECTION

PATENT NO. : 7,702,504 B2
APPLICATION NO. : 10/886662
DATED : April 20, 2010
INVENTOR(S) : Chang-yong Son It is certified that error appears in the above-identified patent and that said Letters Patent is hereby corrected as shown below:

Title Page Column 1 (Title), Line 1, Change "BITRATE" to --BIT RATE--

Column 1, Line 1, Change "BITRATE" to --BIT RATE--

Column 25, Line 32, Change "$C = \sum_{i=0}^{3} s_1 d(m_i)$" to --$C = \sum_{i=0}^{3} s_i d(m_i)$--

Column 25, Line 42, Change "$s_i s_j \phi(m_i m_j),$" to --$s_i s_j \phi(m_i, m_j),$--

Column 26, Line 48, Change "$C = \sum_{i=0}^{3} s_1 d(m_i)$" to --$C = \sum_{i=0}^{3} s_i d(m_i)$--

Column 26, Line 55, Change "equation-," to --equation,--

Column 26, Line 59, Change "$s_i s_j \phi(m_i m_j),$" to --$s_i s_j \phi(m_i, m_j),$--

Column 29, Line 14, Change "$C = \sum_{i=0}^{3} s_1 d(m_i)$" to --$C = \sum_{i=0}^{3} s_i d(m_i)$--

Column 29, Line 24, Change "$s_i s_j \phi(m_i m_j),$" to --$s_i s_j \phi(m_i, m_j),$--

Column 29, Line 30, Change "$s^j$" to --$s_j$--

Column 29, Line 65, Change "$C_G$" to --$c_G$--

Signed and Sealed this

Twenty-seventh Day of July, 2010

David J. Kappos

David J. Kappos
*Director of the United States Patent and Trademark Office*

Column 31, Line 3, Change " $d(n) = \sum_{i=n}^{39} x^i(n)h(i-n) \quad n = 0, \ldots, 39$ " to -- $d(n) = \sum_{i=n}^{39} x^i(n)h(i-n) \quad n = 0, \ldots, 39$, --

Column 31, Line 12, Change " $C = \sum_{i=0}^{3} s_1 d(m_i)$ " to -- $C = \sum_{i=0}^{3} s_i d(m_i)$ --

Column 31, Line 24, Change " $s_i s_j \phi(m_i m_j)$, " to -- $s_i s_j \phi(m_i, m_j)$, --

Column 32, Line 25, Change " $d(n) = \sum_{i=n}^{39} x^i(n)h(i-n) \quad n = 0, \ldots, 39$ " to -- $d(n) = \sum_{i=n}^{39} x^i(n)h(i-n) \quad n = 0, \ldots, 39$, --

Column 32, Line 34, Change " $C = \sum_{i=0}^{3} s_1 d(m_i)$ " to -- $C = \sum_{i=0}^{3} s_i d(m_i)$ --

Column 32, Line 44, Change " $s_i s_j \phi(m_i m_j)$, " to -- $s_i s_j \phi(m_i, m_j)$, --